US005798778A

United States Patent [19]

Kimura et al.

[11] Patent Number: 5,798,778

[45] Date of Patent: Aug. 25, 1998

[54] INK JET HEAD HAVING AN INK DISCHARGING OUTLET FACE AND INK JET APPARATUS PROVIDED WITH SAID INK JET HEAD

[75] Inventors: Makiko Kimura, Sagamihara; Hiroshi Sugitani, Machida; Sadayuki Sugama, Tsukuba; Hiroyuki Ishinaga, Tokyo, all of Japan

[73] Assignee: Canon Kabushiki Kaisha, Tokyo, Japan

[21] Appl. No.: 931,365

[22] Filed: Sep. 16, 1997

Related U.S. Application Data

[63] Continuation of Ser. No. 790,586, Jan. 29, 1997, abandoned, which is a continuation of Ser. No. 244,744, filed as PCT/JP93/01495, Oct. 18, 1993, published as WO94/08793, Apr. 28, 1994, abandoned.

[30] Foreign Application Priority Data

Oct. 19, 1992 [JP] Japan ..... 4-280725
Oct. 19, 1992 [JP] Japan ..... 4-280726

[51] Int. Cl.[6] ..... B41J 2/135; B41J 2/16

[52] U.S. Cl. ..... 347/45

[58] Field of Search ..... 347/45, 47

[56] References Cited

U.S. PATENT DOCUMENTS 4,967,204 10/1990 Terasawa et al. ..... 347/29
5,017,946 5/1991 Masuda et al. ..... 347/45

FOREIGN PATENT DOCUMENTS 60-18485 2/1985 Japan ..... 347/45
2-88247 3/1990 Japan .

*Primary Examiner*—Valerie Lund
*Attorney, Agent, or Firm*—Fitzpatrick, Cella, Harper & Scinto

[57] ABSTRACT

The present invention makes it an object to provide an ink jet head which enables to prevent ink droplets deposited on the discharging outlet face thereof from arriving at the discharging outlets arranged at the discharging outlet face whereby maintaining the discharging outlets in a state that defective ink discharging is not occurred, wherein the discharging outlet face contains a water repellent zone disposed to surround the discharging outlets and a recessed hydrophilic zone disposed in a region on one of the opposite outsides of the water repellent zone and which is distant by a desired distance from the arrangement of the discharging outlets. In the ink jet head, the recessed hydrophilic zone serves to take ink droplets deposited on the discharging outlet face thereinto and because of this, desirable printing can be attained even in the case where printing is conducted at a high speed printing or a high driving frequency.

12 Claims, 15 Drawing Sheets

INK JET HEAD HAVING AN INK DISCHARGING OUTLET FACE AND INK JET APPARATUS PROVIDED WITH SAID INK JET HEAD

This application is a continuation, of application Ser. No. 08/790,586, filed Jan. 29, 1997, which was a continuation of Ser. No. 08/244,744, filed as PCT/JP93/01495 Oct. 18, 1993 published as WO94/08793 Apr. 28, 1994, both now abandoned.

BACKGROUND OF THE INVENTION

1. Field of the Invention

The present invention relates to an ink jet head having an improved discharging outlet face which enables the ink jet head to always perform ink discharging in a stable state. The present invention also relates to an ink jet apparatus provided with said ink jet head having an improved discharging head. The present invention further includes a process for producing said ink jet head having an improved discharging outlet face.

2. Related Background Art

As for recording systems, a number of proposals have already been made. Among the proposed recording systems, ink jet recording systems have been spotlighted and widely used since they are non-impact recording systems and low in noise and in addition to these advantages, they are capable of performing high speed recording.

There are known a number of ink jet apparatus suitable for practicing such ink jet recording system. Among those ink jet apparatus, the ink jet apparatus based on the system of conducting ink discharging by way of producing film boiling by virtue of thermal energy are presently evaluated as being practically advantageous because the direction of ink to be discharged can be maintained in a stable state as desired. However, as for such ink jet apparatus, there are still some problems required to solve such that following ink droplets discharged from the discharging outlets in response to a recording signal applied, minute ink particles are often generated through the discharging outlets and other than this, very minute ink particles are often rebounded upon arrival of ink droplets discharged from the discharging outlets at a recording sheet, wherein these minute ink particles (which will be occasionally referred to as ink mist in the following) are eventually deposited to form pools each comprising an aggregate of minute ink particles on the discharging outlet face of the ink jet head of the ink jet apparatus and they remain in the vicinity of the discharging outlets arranged at the discharging outlet face to interrupt successive ink discharging from the discharging outlets or to often make some of the discharging outlets unable to perform ink discharging.

Japanese Patent Laid-open application No. 211959/1992 proposes a technique of eliminating the problems above described in that the discharging outlet face of an ink jet head at which a plurality of discharging outlets are arranged is applied with a water repellent material.

FIG. 1 is a schematic illustrating the constitution of an ink jet head described in the above patent literature which has a discharging outlet face applied with a water repellent material to the surface thereof. In FIG. 1, reference numeral 101 indicates a water repellent film, reference numeral 102 an ink supply port, reference numeral 103 a grooved top plate including portions of integrally forming nozzles, liquid chamber, and liquid pathways (not shown in the figure), reference numeral 104 a discharging outlet, reference numeral 104*a* a discharging outlet face at which a plurality of discharging outlets 104 are spacedly arranged, and reference numeral 105 a substrate for an ink jet head, said substrate including elements (not shown in the figure) for discharging ink from the discharging outlets. In the configuration shown in FIG. 1, the water repellent film is formed substantially over the entire region of the discharging outlet face 104*a*. According to this configuration in which the water repellent film 101 is formed substantially over the entire region of the discharging outlet face 104*a*, occasion for ink mist to stay in the peripheral area of the discharging outlets is diminished and because of this, the foregoing problems of causing defects in the discharging performance of the discharging outlets in the prior art can be solved to a certain extent. However, even for this ink jet head with the discharging outlet face applied with the water repellent film, when recording is continuously conducted over a long period of time at a high speed and under conditions of a high frequency driving pulse and a high duty, there is a tendency that ink mist gradually deposits on the discharging outlet face to cause ink residues thereon, resulting in getting into the discharging outlets whereby causing defective recording. The technique described in the Japanese patent literature is difficult to sufficiently prevent the occurrence of this problem. This situation has been found out as a result of experimental studies by the present inventors about the technique described in the above Japanese patent literature.

Incidentally, as above described, it is generally recognized that ink mists deposited on the discharging outlet face of an ink jet head entail deterioration in terms of the ink discharging performance. However, as for the mechanism for such ink mist deposited on the discharging outlet face to impart a negative influence to the discharging outlets in terms of their ink discharging performance, it has not sufficiently been clarified yet.

In the following, description will be made of the findings obtained as a result of the experimental studies by the present inventors about the mechanism of how ink mists deposited on the discharging outlet face influence to the discharging outlets in terms of their ink discharging performance.

That is, as for an ink jet head configured as shown in FIG. 1 in which its discharging outlet face is applied with the foregoing water repellent film to the substantially entire region thereof, there was obtained a finding that when recording is continuously conducted at a high frequency driving pulse and a high recording speed over a long period of time, ink mist is liable to increasingly deposit at given regions of the water repellent film disposed on the discharging outlet face which are distant from the arrangement of the discharging outlets. Particularly, a plurality of ink mist aggregates of 300 μm to 500 μm in diameter will often become present in the regions of the water repellent film disposed on the discharging outlet face which are distant by about 500 μm to 1 mm from the arrangement of the discharging outlets. The present inventors obtained a further finding that the contact angle of the surface of the water repellent film against liquid (that is, ink) is relatively large and because of this, the ink exhibits a great fluidity accordingly, wherein when said contact angle is 80° or above, the ink becomes markedly fluidized. In addition to these findings, the present inventors obtained a still further finding that when the recording is continuously conducted by reciprocating the ink jet head, the above-described ink mist aggregates start moving by virtue of an inertia force due to the reciprocating motion or by virtue of their own weight to finally arrive at and get into some of the discharging outlets, resulting in disabling the discharging outlets in terms of their ink discharging performance.

Other than the above proposal, U.S. Pat. No. 5,121,134 describes an ink jet head having a discharging outlet face with a treated surface, said discharging outlet face having a plurality of discharging outlets being arranged therein, in which the peripheral area of each discharging outlet is made to be comprised of a zone portion having a good solvent wettable property (that is, a so-called hydrophilic zone portion) and each adjacent discharging outlets each being surrounded by said solvent-wettable zone portion is segmented by a zone portion having a solvent non-wettable property (that is, a so-called water repellent zone portion). And this patent literature also describes another configuration of the discharging outlet face of an ink jet head in which an annular area on the face of the nozzle plate surrounding each nozzle is made to be solvent non-wettable and the remaining area of the face is made to be solvent wettable. In any of these cases, problems unavoidably entail even in the latter case. That is, for instance, ink mists deposited on the water repellent zone portions situated in the vicinity of the respective discharging outlets are often gathered to grow into ink droplets of about 50 μm to 100 μm in diameter, wherein as the water repellent zone portions are relatively great in terms of the contact angle against the ink and those ink droplets therefore possess an increased fluidity, the ink droplets eventually arrive at the hydrophilic zone portions by which the respective discharging outlets are segmented where they take up other ink mists present nearby to further grow in terms of their size while increasing their fluidity, and the thus grown ink droplets go beyond the respective water repellent zone portions and eventually get into the discharging outlets.

The above situation of gathering ink mists into a large-sized ink droplet on the discharging outlet face is further facilitated in the case where capping is conducted. Particularly, when a capping means for protecting the discharging outlets and recovering their discharging performance is contacted to the discharging outlet face having ink mists deposited thereon, those ink mists move along the periphery of the capping means and they are gathered to provide large-sized ink droplets. The ink droplets thus resulted are left on the discharging outlet face when the capping means is detached. Those ink droplets are readily mobile on the discharging outlet face because they are remarkably large in size, and they eventually arrive at the discharging outlets, wherein they often get into the discharging outlets, resulting in disabling some of the discharging outlets in terms of their discharging performance.

SUMMARY OF THE INVENTION

A principal object of the present invention is to eliminate the foregoing problems in the prior art and to provide an ink jet head having an improved discharging outlet face.

Another object of the present invention is to provide an ink jet head having an improved discharging outlet face which enables to always ensure stable ink discharging even in the case where the frequency of the cleaning operation by means of a cleaning member for the discharging outlet face is markedly diminished in a situation where ink discharging is being continuously conducting over a long period of time.

A further object of the present invention is to provide an improved ink jet head wherein ink mists deposited on the discharging outlet face are converted into a substantially immobile state such that they do not get in to the discharging outlets.

A further object of the present invention is to provide an improved ink jet head wherein ink mists deposited on the discharging outlet face are converted into such a state that they are not mobilized upon contacting a capping means to the discharging outlet face, and ink droplets left on the discharging outlet face upon detaching the capping means are substantially immobilized such that they do not get into the discharging outlets.

A further object of the present invention is to provide an ink jet apparatus provided with the above ink jet head.

A further object of the present invention is to provide a process for producing the above ink jet head.

The present invention has been accomplished as a result of extensive studies through experiments by the present inventors in order to attain the above objects.

That is, as a result of the experimental studies, the present inventors obtained a finding that when a belt-like shaped hydrophilic zone is formed at a water repellent layer disposed on a discharging outlet face of an ink jet head such that it is situated along the arrangement of a plurality of discharging outlets being arranged in the discharging outlet face while maintaining a given distance from the arrangement of the discharging outlets wherein the belt-like shaped hydrophilic zone comprises a belt-like shaped groove structure comprising a hydrophilic bottom portion and water repellent sidewall portions, said belt-like shaped groove structure having been formed by removing a given part of the water repellent layer together with the corresponding part of the substrate of the ink jet head, ink mists deposited in the vicinity of each discharging outlet are moved into the belt-like shaped hydrophilic zone without leaving any ink mist in the vicinity of each discharging outlet and without causing growth of those ink mists in the vicinity of each discharging outlet.

The present invention has been accomplished based on this finding.

DESCRIPTION OF THE INVENTION AND THE PREFERRED EMBODIMENTS

The present invention is applicable to ink jet heads used in the bubble jet system belonging to the on-demand type ink jet system, ink jet heads used in the piezo system belonging to the on-demand type ink jet system, ink jet heads used in the continuous type ink jet system, and ink jet heads used in the electrostatic suction type ink jet system. In any case wherein the present invention is applied, the ink jet head is provided with, at least, a discharging outlet for discharging ink, an ink pathway in communication with said discharging outlet, and an energy generating element capable of generating energy for discharging said ink through said discharging outlet, said energy generating element being disposed in said ink pathway, and the ink jet head has a discharging outlet face at which said discharging outlet is arranged. In any case, it is essential for the discharging outlet face to have a recessed hydrophilic zone disposed at a position of the discharging outlet face which is distant by a given distance from the discharging outlet.

A first typical embodiment of the present invention is directed to an ink jet head having a discharging outlet face with a plurality of discharging outlets being arranged therein, characterized in that the peripheral area of the discharging outlets comprises a water repellent zone and a belt-like shaped, recessed hydrophilic zone (which will be hereinafter referred to as belt-like shaped hydrophilic zone) is formed in an area of the discharging outlet face which is distant by a given distance from the arrangement of the discharging outlets and which is situated next to the water repellent zone.

A second typical embodiment of the present invention is directed to an ink jet head having a discharging outlet face with a plurality of discharging outlets being arranged therein, characterized in that the peripheral area of the discharging outlets comprises a water repellent zone and a partially water repellent zone comprising a number of small hydrophilic zones spacedly disposed in a water repellent zone so as to divide said water repellent zone into a number of small water repellent zones is formed in an area of the discharging outlet face which is distant by a given distance from the arrangement of the discharging outlets and which is situated next to the water repellent zone.

A third typical embodiment of the present invention is directed to an ink jet head having a discharging outlet face with a plurality of discharging outlets being arranged therein, characterized in that the peripheral area of the discharging outlets comprises a water repellent zone and a belt-like shaped, recessed hydrophilic zone (which will be hereinafter referred to as belt-like shaped hydrophilic zone) is formed in an area of the discharging outlet face which is distant by a given distance from the arrangement of the discharging outlets and which is situated next to the water repellent zone.

In the present invention, by forming the foregoing belt-like shaped hydrophilic zone in an area of the discharging outlet face which is distant by a given distance from the arrangement of the discharging outlets and which is situated next to the water repellent zone surrounding the discharging outlets, mink mists deposited on the peripheries of the discharging outlets are moved toward and taken into the hydrophilic zone before they are grown into large-sized ink droplets. In addition, even if ink droplets liable to move toward the discharging outlets should be present on the discharging outlet face, they are desirably taken into the belt-like shaped hydrophilic zone and therefore, they are effectively prevented from arriving at the discharging outlets, wherein the discharging outlets are stably maintained in terms of their discharging performance without suffering from influences of the ink droplets.

Further, by forming the foregoing partially water repellent zone with a number of specedly distributed small hydrophilic zones in the discharging outlet face, occurrence of ink droplets on the discharging outlet face is effectively prevented by virtue of ink repelling effects provided by the small water repellent zones and ink separating effects provided by the small hydrophilic zones. And even if a large-sized ink droplet should be occurred on the discharging outlet face, such large-sized ink droplet is divided into small ink droplets by the actions of the small hydrophilic zones and the resulting small ink droplets are taken into the small hydrophilic zones. Thus, ink droplets on the discharging outlet face are always prevented from moving toward the discharging outlets, whereby the discharging outlets are stable maintained without being disabled in terms of their discharging performance.

In the present invention, the partially water repellent zone with a number of specedly distributed small hydrophilic zones is designed such that ink mists deposited on the discharging outlet face are effectively taken into the small hydrophilic zones before they are gathered to provide mobile ink droplets and that ink droplets incidentally occurred are divided into small ink droplets by the actions of the small hydrophilic zones and the resulting small ink droplets are taken into and maintained by the small hydrophilic zones. Particularly, it is desired for the small hydrophilic zones of the partially water repellent zone to be spacedly arranged to have a given interval between each adjacent small hydrophilic zones so that a grown ink droplet is effectively divided into small-sized ink droplets, which can be taken into and maintained by the small hydrophilic zones. In general, said interval between each adjacent small hydrophilic zones is desired to be less than 500 μm which corresponds to the size of a mobile ink drop let which is randomly moving on the discharging outlet face of a conventional ink jet head. In a more preferable embodiment, it is determined in the range of from a few micron meters to 300 μm. In the most preferred embodiment, it is determined in the range of from 65 to 200 μm. By this, not only ink droplets having a size of about 100 μm or less which are not mobile or liable to move but also other mobile ink droplets are desirably taken into the small hydrophilic zones or divided into small ink droplets by the actions of the small hydrophilic zones, followed by being taken into the small hydrophilic zones.

In the following, description will be made of occurrence of ink mists and growth of the ink mists on the discharging outlet face of a conventional ink jet head. Description will be also made of the bases for the above described figures.

Deposition of ink mists on the discharging outlet face of the ink jet head is occurred during the recording operation. That is, when ink is discharged from the discharging outlets of the ink jet head toward a recording member while moving the ink jet head to scan the recording face of the recording member, fine particles of the ink are unavoidably rebounded upon the arrival of the discharged ink at the recording face of the recording member to thereby produced ink mists. Other than this, ink fine particles are sometimes caused upon discharging principal ink droplets from the discharging outlets, wherein ink mists are produced. The ink mists thus occurred come to fly at the discharging outlet face at a slight time lag from the moment of the discharged ink to have arrived at the recording face of the recording member, when the ink jet head has already moved for successive ink discharging. Thus, the ink mists are deposited on the discharging outlet face of the ink jet head, wherein deposition of the ink mists is occurred mainly at one side area of the discharging outlet face opposite the direction of the ink jet head to move. The observed results obtained by the present inventors revealed that deposition of ink mists is mainly occurred or/and growth of ink droplets is mainly in the area of the discharging outlet face which is distant by about 800 μm to 1.5 mm from the arrangement of the discharging outlets.

In the following, description will be made of the results obtained by the present inventors as a result of having conducted printing operation several times using a conventional ink jet head of the configuration shown in FIG. 1 provided with a discharging outlet face applied with water-repelling treatment to the entire surface thereof without cleaning the discharging outlet face as will be described below, and optically observed the surface state of the discharging outlet face of the ink jet head by means of a microscope after each printing operation.

Particularly, initial printing was conducted by operating the above ink jet head. And optical observation was made of the situation of ink mists deposited on the discharging outlet face. The observed results revealed that ink mists of about 50 μm in diameter are distributed substantially uniformly on the discharging outlet face.

The ink jet head used in the above was then subjected to successive printing operation. Optical observation was made again of the situation of ink mists deposited on the discharging outlet face. The observed results revealed that the number of the previously deposited ink mists with about 50 μm in diameter is decreased but ink droplets of about 100 μm in diameter are ununiformly distributed in mobile state on the discharging outlet face. Based on the results obtained, there was obtained a finding that the ink mists with about 50 μm in diameter occurred in the initial printing operation are coalesced while gathering newly deposited ink mists nearby in the successive printing operation to produce such mobile large-sized ink droplets of about 100 μm in diameter, and these large-sized ink droplets are randomly moved and ununiformly distributed on the discharging outlet face. From this, it is considered that the size of about 100 μm in diameter is the minimum size for an ink droplet to start mobilizing on the discharging outlet face.

The ink jet head used in the above was subjected to further printing operation. Then, optical observation was made of the situation of ink droplets on the discharging outlet face. The observed results revealed that ink droplets of about 300 μm to 400 μm in diameter are ununiformly distributed in mobile state on the discharging outlet face. Based on the results obtained, there was obtained a finding that the ink droplets with about 100 μm in diameter occurred in the second printing operation gather newly deposited ink mists nearby or/and other ink droplets to produce such mobile large-sized ink droplets, and these ink droplets are readily mobile over an extended area of the discharging outlet face while easily gathering other ink droplets or/and ink mists if they are present nearby.

The ink jet head used in the above was subjected to still further printing operation. Then, optical observation was made of the situation of ink droplets on the discharging outlet face. The observed results revealed that ink droplets of about 500 μm in diameter are ununiformly distributed in mobile state over an extended area of the discharging outlet face, wherein some of the large-sized ink droplets are present in the vicinity of or at some of the discharging outlets.

While referring to the experimental results obtained in the above, description will be made of the behavior of the ink mists deposited on the water repellent discharging outlet face of the conventional ink jet head with reference to FIG. 2.

As the printing operation using the conventional ink jet head is repeatedly conducted, ink mists 21 of about 50 to 100 μm in diameter deposited on the discharging outlet face applied with water repelling treatment to the entire surface thereof move while gathering ink mists newly deposited to grow their size whereby providing ink droplets 22 of about 500 μm in diameter in readily mobile state. These ink droplets 22 of about 500 μm in diameter randomly move on the discharging outlet face to often arrive at an area in the vicinity of discharging outlets 20, wherein an intertial force caused upon reciprocating the ink jet head should be effected, they readily arrive at the discharging outlets 20 to deteriorate the discharging outlets in terms of their discharging performance. Particularly, in the case where those ink droplets are moved to the area in close proximity to the discharging outlets 20, specifically to the area which is about 1.5 mm or less distant from the arrangement of the discharging outlets, they gather other ink droplets to provide large-sized ink droplets of about 600 μm to 1 mm in diameter during their movement, and these large-sized ink droplets readily arrive at the discharging outlets, wherein they get into the discharging outlets to deteriorate their discharging performance.

The results of experimental studies by the present inventors about the behavior of ink mists deposited on the discharging outlet face in the case of contacting a capping means to the discharging outlet face revealed that those ink mists are forcedly gathered within the confined area inside the contact region 24 of the discharging outlet face where the capping means is contacted, wherein the ink mists are readily gathered to provide an extremely large coalesced liquid body 23, and once the coalesced liquid body should be formed, it moves toward the discharging outlets immediately after the capping means is detached wherein the discharging outlets are filled with the coalesced liquid body.

According to the present invention, occurrence of the above problems in the prior art can be effectively eliminated, wherein the foregoing belt-like shaped hydrophilic zone arranged along the arrangement of the discharging outlets effectively take up ink droplets moving toward the discharging outlets on the discharging outlet face and in addition to this, the island-like shaped hydrophilic zone comprising the foregoing partially water repellent zone effects not only to make ink droplets present on the discharging outlet face to be of about 100 μm or less in diameter but also to divide large-sized ink droplets having a size of greater than 100 μm in diameter into small-sized ink droplets having a size of less than 100 μm in diameter by virtue of the distribution of its small hydrophilic zones, wherein any ink droplets occurred on the discharging outlet face are effectively taken into the island-like shaped hydrophilic zone to thereby prevent them from arriving at the discharging outlets.

While referring to the above description, description will be made of a typical embodiment of a discharging outlet face in which the present invention is applied, while referring to FIG. 3.

The discharging outlet face shown in FIG. 3 is provided with a central water repellent zone E disposed at a substantially central position thereof in which a plurality of discharging outlets D each having a bore of about 30 μm are spacedly arranged at a given arrangement density at the cental region while maintaining a given equal distance H from each of the opposite side ends. On each of the opposite outsides of the central water repellent zone E, there is disposed a recessed hydrophilic zone such that it is situated next to the central water repellent zone. Particularly, a first recessed hydrophilic zone C1 having a given width E and a second recessed hydrophilic zone C2 having a given width W are disposed so as to sandwich the central water repellent zone, wherein the two recessed hydrophilic zones are arranged along the arrangement of the discharging outlets. Further on the opposite outsides of the two recessed hydrophilic zones, there are disposed a first outer hydrophilic zone B1 and a second outer hydrophilic zone B2 each comprising a plurality of island-like hydrophilic recesses spacedly distributed in a water repellent zone such that each of them is situated next to the corresponding recessed hydrophilic zone.

Specifically, for instance, the above distance H is made to be about 35 μm to 110 μm, and the above width of each of the first and second recessed hydrophilic zones C1 and C2 is made to be 100 μm to 400 μm.

Each of the first and second recessed hydrophilic zones C1 and C2 is desired to be in a belt-like shaped form so that it serves to effectively take ink droplets moving from the outer area of the discharging outlet face toward the arrangement of the discharging outlets into the beltlike shaped, recessed hydrophilic zone whereby preventing those ink droplets from arriving at the discharging outlets.

As for the position for each of the first and second outer hydrophilic zones B1 and B2 to be disposed outside the corresponding recessed hydrophilic zone on the discharging outlet face, each of them is disposed, for instance, in a given area of the discharging outlet face which is 600 μm to 1.8 mm distant from the discharging outlet arrangement D. In a specific example, the island-like hydrophilic recesses of each outer hydrophilic zone are designed such that they are spacedly arranged to have a give interval of about 65 μm to 200 μm between each adjacent island-like hydrophilic recesses so as to make them capable of effecting to a readily mobile large-sized ink droplet, for example, of about 500 μm in diameter whereby dividing such a large-sized ink droplet into small-sized ink droplets.

The foregoing recessed hydrophilic zone and the foregoing island-like hydrophilic recesses in the present invention may be properly formed in a manner comprising providing an integrated body comprising a discharging outlet-forming plate made of a solvent-wettable resin and a water repellent film laminated on the surface thereof and subjecting the integrated body to laser processing wherein laser beam is irradiated to the integrated body through the water repellent film side to thereby remove predetermined portions of the water repellent film and the corresponding surface portions of the integrated body situated under the water repellent film portions. The resultant obtained by this manner has such a cross section as shown in FIG. 11(B), wherein reference numeral 5 indicates a recessed hydrophilic zone. As apparent from the figure, the recessed hydrophilic zone 5 comprises a grooved structure having a bottom comprised of an exposed portion of the resin, which serves as a hydrophilic zone, and upstand side walls partly comprised of exposed portions of the resin and chiefly comprised of the water repellent film.

Ink droplets taken into the recessed hydrophilic zones thus formed are adhered to their hydrophilic bottom and their hydrophilic side wall portions, wherein these ink droplets are immobilized so that they are hardly moved on the discharging outlet face. These immobilized ink droplets are eventually removed by the later described cleaning operation which is conducted for the discharging outlet face.

The depth of the recessed hydrophilic zone should be properly determined depending upon the thickness of the water repellent film. Specifically, when the thickness of the water repellent film is 0.1 μm to 0.2 μm, the depth is desired to be 0.2 μm to 0.6 μm.

Now, as above described with reference to FIG. 2, when the capping means is contacted to the discharging outlet face, there is a tendency that ink mists are readily gathered to provide an extremely large coalesced liquid body. In order to effectively divide such coalesced liquid body into small-sized ink droplets, a water repellent zone containing a number of small hydrophilic zones being spacedly distributed therein may be disposed either in a limited area of the discharging outlet face which is to be enclosed by the capping means or in other limited area of the discharging outlet face where the capping means is to be contacted.

As above described, each of the first and second recessed hydrophilic zones C1 and C2 is desired to be in a belt-like shaped form. However, in an alternative, any of these hydrophilic zones may be designed such that the belt-like shaped portion is appropriately segmented so as to provide a configuration similar to that of the foregoing outer hydrophilic zone, as long as such configuration functions to effectively prevent ink mists from moving toward the discharging outlets.

The present invention is not limited only to the above described embodiment but includes other embodiments derived from FIG. 3, specifically, an embodiment in which only the first and second recessed hydrophilic zones C1 and C2 are disposed on the opposite sides of the discharging outlet arrangement, an embodiment in which only the first and second outer hydrophilic zones B1 and B2 are disposed on the opposite sides of the discharging outlet arrangement, and an embodiment in which only one of the opposite side areas of the discharging outlet arrangement is applied with hydrophilic treatment, for example, only the first recessed hydrophilic zone C1 and the first outer hydrophilic zone B1 are disposed.

The ink jet head provided with the foregoing specific discharging outlet face according to the present invention enables to desirably conduct high frequency printing, high duty printing and high speed printing continuously over a long period of time without causing defective printing, wherein ink mists deposited at an increased amount on the discharging outlet face are effectively immobilized so that they are not moved toward the discharging outlets. In addition, the ink jet head according head is advantageous in that ink droplets hardly reach the discharging outlets and the amount of ink deposits to be removed from the discharging outlets by the cleaning means is therefore slight and because of this, the cleaning operation for the discharging outlet face can be conducted at a reduced cleaning pressure, wherein the lifetime of the water repellent portion of the discharging outlet face is prolonged.

The discharging outlet face for an ink jet head according to the present invention may take any of the patterns shown in FIGS. 5 to 13 with respect to the water repellent zone and hydrophilic zone. It should be understood that any of the patterns of the hydrophilic zones formed at the respective discharging outlet faces shown in these figures is formed after a water repellent film has been formed on the entire area of the discharging outlet face.

FIG. 5 shows a processed pattern at the discharging outlet face in the present invention. In FIG. 5, there is shown a discharging outlet-forming plate 1 provided at a top plate having an ink supply port, said discharging outlet-forming plate being provided with a discharging outlet face 8 having a water repellent film formed thereon. The surface pattern of the discharging outlet face in this figure comprises a central water repellent zone in which a plurality of discharging outlets 4 are spacedly arranged throughout a length l, a pair of belt-like shaped, recessed hydrophilic zones 5 disposed on the opposite sides of the arrangement of the discharging outlets such that they sandwich the central water repellent zone, and a pair of outer hydrophilic zones 6 each being disposed on the outside of one of the belt-like shaped, recessed hydrophilic zones 5, each of said outer hydrophilic zones comprising a plurality of island-like hydrophilic recesses spacedly distributed in the corresponding area of the water repellent film formed on the discharging outlet face 8.

The distance $H_1$ or $H_2$ between the arrangement of discharging outlets in the central water repellent zone and the beginning end of each of the belt-like shaped, recessed hydrophilic zones 5 and the width $W_1$ or $W_2$ of each of the belt-like shaped, recessed hydrophilic zones 5 should be properly determined depending upon the kind of ink used, the discharging outlet size, and other related conditions. Preferred figures of the above distance and width will be later described.

As for the length of each of the above belt-like shaped, recessed hydrophilic zones 5, it is desired to be substantially the same as to or greater than the length of the arrangement area of the discharging outlets in the central water repellent zone.

As for the island-like hydrophilic recesses of the outer hydrophilic zone 6 which is disposed outside each of the belt-like shaped, recessed hydrophilic zones 5, it is possible for them to have a straight-sided form or a round form. However, in the viewpoint of effectively interrupting the movement of ink mists or ink droplets to be taken into the island-like recesses, the straight-sided form is the most desirable. In the embodiment shown in FIG. 5, each of the island-like recesses is shaped in a hexagonal form.

As for the area of each of the island-like recesses and the distribution density of the island-like recesses, description will be made in Experiments 1 to 3 which will be later described. In FIG. 5, reference numeral 7 indicates a given area of the discharging outlet face 8 where a capping means is to be contacted.

The discharging outlet face pattern embodiment shown in FIG. 6 is a modification of the pattern shown in FIG. 5. The pattern shown in FIG. 6 comprises, as well as in the case of the pattern shown in FIG. 5, a pair of belt-like shaped, recessed hydrophilic zones 5 disposed so as to sandwich the central water repellent zone containing the discharging outlet arrangement and a pair of outer hydrophilic zones 6 each being disposed outside one of the belt-like shaped, recessed hydrophilic zones, each of said outer hydrophilic zones comprising a plurality of hexagonal island-like hydrophilic recesses spacedly distributed in the corresponding area of the water repellent film formed on the discharging outlet face, and wherein each of the belt-like shaped, recessed hydrophilic zones 5 is configured to have a plurality of protrusions spacedly arranged at the periphery thereof opposite the discharging outlet arrangement.

The protrusions of each belt-like shaped, recessed hydrophilic zones are spacedly arranged such that each of them is situated so as to supplement the space between each adjacent island-like recesses in the corresponding outer hydrophilic zone 6. By having the belt-like shaped, recessed hydrophilic zone configured in this way, a continuation is established between the belt-like shaped, recessed hydrophilic zone 5 and the outer hydrophilic zone 6, wherein ink droplets disposed on the discharging outlet face are effectively taken into these hydrophilic zones.

The discharging outlet face pattern embodiment shown in FIG. 7 is a modification of the embodiment shown in FIG. 5, which comprises only a pair of belt-like shaped, recessed hydrophilic zones 5 each being disposed on one of the opposite sides of the central water repellent zone containing the arrangement of the discharging outlets 4, without disposing any outer hydrophilic zone. In this embodiment, ink mists deposited in the vicinity of the discharging outlets 4 are moved toward and taken into each of the belt-like shaped, recessed hydrophilic zones 5, wherein the object of the present invention can be attained as desired. Each of the two belt-like shaped, recessed hydrophilic zones may be provided with a plurality of protrusions as well as in the case of the belt-like shaped, recessed hydrophilic zones shown in FIG. 6.

The discharging outlet face pattern embodiment shown in FIG. 8 is a modification of the embodiment shown in FIG. 5, which comprises a belt-like shaped, recessed hydrophilic zone disposed only on one of the opposite sides of the central water repellent zone containing the arrangement of the discharging outlets 4 and an outer hydrophilic zone 6 disposed in one outside area of the discharging outlet face 8, specifically, said outer hydrophilic zone being disposed outside said belt-like shaped, recessed hydrophilic zone.

An ink jet head provided with a discharging outlet face having hydrophilic zones patterned as shown in FIG. 8 is effective when it is employed in a scanning type ink jet apparatus in which ink discharging is cased only when the ink jet head is moved in a given direction, to thereby perform recording. Particularly, in the ink jet apparatus of this type, ink mists are basically deposited on a limited area of the discharging outlet face 8 of the ink jet head which is situated in the downstream side of the direction for the ink jet head to scan while conducting ink discharging. Therefore, it is sufficient for the belt-like shaped, recessed hydrophilic zone 5 and the outer hydrophilic zone 6 to be disposed only in such limited area of the discharging outlet face where ink mists are deposited, wherein those ink mists deposited are effectively prevented from arriving at the discharging outlets whereby desirable ink discharging can be maintained.

The discharging outlet face embodiment shown in FIG. 9 is a modification of the embodiment shown in FIG. 5 or FIG. 8. Particularly, this embodiment comprises a modification of the embodiment shown in FIG. 8 which further comprises an additional belt-like shaped, recessed hydrophilic zone 5 disposed on the remaining outside of the central water repellent zone containing the arrangement of the discharging outlets 4. It can be said that this embodiment corresponds to a modification of the embodiment shown in FIG. 7.

The hydrophilic zone pattern shown in FIG. 9 is effective in an ink jet apparatus of the type described in the case of FIG. 8 which performs one direction recording, wherein not only ink mists basically deposited on a limited area of the discharging outlet face of the ink jet head which is situated in the downstream side of the direction for the ink jet head to scan while conducting ink discharging but also ink mists possibly deposited on the other area of the discharging outlet face which is situated in the upstream side of the direction for the ink jet head to scan are effectively taken into the belt-like shaped, recessed hydrophilic zones 5 to thereby prevent those ink mists from arriving at the discharging outlets, whereby desirable ink discharging can be maintained.

The discharging outlet face embodiment shown in FIG. 10 is a modification of the embodiment shown in FIG. 5 in which the hexagonal hydrophilic recesses in each of the two outer hydrophilic zones 6 in the embodiment shown in FIG. 5 are replaced by a plurality of rectangular hydrophilic recesses spacedly arranged such that they are perpendicular to the arrangement of the discharging outlets 4.

In this embodiment, each of the island-like hydrophilic recesses distributed in each of the outer hydrophilic zones 6 may be shaped in a rectangular form as shown in FIG. 10. Alternatively, it may be shaped in a triangle-like form with a base facing toward the arrangement of the discharging outlets 4 and which is gradually narrowed toward the opposite side of the arrangement of the discharging outlets 4. In this figure, reference numeral 7 indicates a given area of the discharging outlet face where a capping means is to be contacted. In this embodiment, each of the two outer hydrophilic zones 6 is disposed in said area where the capping means is to be contacted.

According to this embodiment in which the outer hydrophilic zones 6 are disposed to overlap with the area where the capping means is to be contacted, such a large coalesced liquid body described in FIG. 2, which will be occurred upon the capping operation, can be effectively prevented from occurring because ink droplets liable to grow into such liquid body are effectively divided by and taken into the respective outer hydrophilic zones 6, wherein those ink droplets are prevented from arriving at the discharging outlets 4.

The discharging outlet face embodiment shown in FIGS. 11(A) and 11(B) is a modification of the embodiment shown in FIG. 5 in which each of the two outer hydrophilic zones 6 in the embodiment shown in FIG. 5 is replaced by a belt-like shaped, recessed hydrophilic zone 9 which is positioned so as to establish a water repellent zone between said hydrophilic zone 9 and the corresponding belt-like shaped, recessed hydrophilic zone 5. The hydrophilic zone pattern in this embodiment can be easily formed by using an appropriate patterning mask capable of forming such hydrophilic zone pattern as shown in the figure.

FIG. 11 (B) is a schematic sectional view of the pattern shown in FIG. 11(A). Each of the outer belt-like shaped, recessed hydrophilic zones 9 in this embodiment comprises a grooved structure having a depth which is greater by some holds over that of the belt-like shaped, recessed hydrophilic zone 5.

According to this embodiment, each of the two outer belt-like shaped, recessed hydrophilic zones 9 having a relatively greater depth effectively takes up ink mists deposited on the discharging outlet face at earlier stage and exhibits a prominent effect in that ink droplets are very efficiently divided by and taken into the outer belt-like shaped, recessed hydrophilic zone 9. In addition, in this embodiment, since each of the two outer belt-like shaped, recessed hydrophilic zones is disposed in a given area 7 of the discharging outlet face 8 where the capping means is to be contacted, as well as in the case of FIG. 10, any large coalesced liquid body which will be occurred upon the capping operation can be efficiently prevented from occurring because ink droplets liable to grow into such liquid body are effectively divided by and taken into the respective outer belt-like shaped, recessed hydrophilic zones 9.

The depth of the grooved structure of each outer belt-like shaped, recessed hydrophilic zone 9 is desired to be 20 μm to 30 μm.

The belt-like shaped, recessed hydrophilic zones 5 and the outer belt-like shaped, recessed hydrophilic zones 9 may be properly formed by providing a discharging outlet face applied with water repelling treatment to the entire surface of thereof and subjecting the discharging outlet face to processing by way of excimer laser irradiation in a manner as will be later described, wherein predetermined portions of the water repellent material constituting the surface of the discharging outlet face are removed to form these hydrophilic zones. In this case, there can be formed different belt-like shaped, recessed hydrophilic zones having a different depth by repeating the eximer laser irradiation several times using an appropriate patterning mask upon forming the belt-like shaped, recessed hydrophilic zone having a relatively greater depth.

The discharging outlet face embodiment shown in FIG. 12 comprises a combination of the patterns of the belt-like shaped, recessed hydrophilic zones 5 and the outer hydrophilic zones 6 shown in FIG. 5 and the patterns of the outer belt-like shaped, recessed hydrophilic zones 9 shown in FIGS. 11(A) and 11(B). In this embodiment, the effects provided by the respective cases are combinedly provided.

The discharging outlet face embodiment shown in FIG. 13 is a modification of the embodiment shown in FIG. 5. This embodiment comprises two inner hydrophilic zones each being positioned on one of the opposite outsides of the central water repellent zone containing a plurality of discharging outlets 41 being spacedly arranged therein and along the arrangement of the discharging outlets, each inner hydrophilic zone containing a plurality of semicircular hydrophilic recesses 51 spacedly arranged such that each semicircular hydrophilic recess circumscribes one of the discharging outlets 41, wherein a first outer hydrophilic zone is positioned outside each inner hydrophilic zone and a second outer hydrophilic zone is positioned outside each first outer hydrophilic zone, said first outer hydrophilic zone containing a plurality of triangle recesses 61 each having a base facing toward the arrangement of the discharging outlets and which are spacedly arranged along the arrangement of the discharging outlets 41, and said second outer hydrophilic zone containing a plurality of triangle recesses 61' each having a base facing toward the arrangement of the discharging outlets and which are spacedly arranged along the arrangement of the discharging outlets 41. In this embodiment, each of the triangle recesses 61 in the first outer hydrophilic zone is arranged such that it supplements a space between each adjacent triangle recesses 61' in the second outer hydrophilic zone.

According to this embodiment, if ink mists or ink droplets on the discharging outlet face should start gathering while moving toward the discharging outlets, those ink mists or ink droplets are instantly taken into the triangle recesses 61' of the second outer hydrophilic zone and/or they are divided into small ink droplets by the triangle recesses 61' so that they are prevented from moving toward the discharging outlets because the water repellent area of the second outer hydrophilic zone is gradually narrowed toward the arrangement of the discharging outlets 41 because of the presence of the triangle hydrophilic recesses 61'. And, in the case where there are some ink droplets which have passed through the second outer hydrophilic zone, they are effectively taken into the triangle hydrophilic recesses 61 of the first outer hydrophilic zone, whereby they are prevented from moving toward the arrangement of the discharging outlets. Thus, ink mists or/and ink droplets present in an outside area of the discharging outlet face are desirably prevented from moving toward the arrangement of the discharging outlets.

In addition, in the case where there are some ink droplets which have passed through the first outer hydrophilic zone, they are entirely taken into the semicircular hydrophilic recesses 51 of the inner hydrophilic zone which are arranged to circumscribe the discharging outlets whereby they are effectively prevented from arriving at the discharging outlets, wherein if other ink droplets or ink mists should be present in the vicinity of the arrangement of the discharging outlets, they are also effectively taken into the semicircular recesses so that they are prevented from arriving at the discharging outlets. Hence, the discharging outlets are always maintained in a desirable state without being filled with ink droplets.

In the above, the distance between each semicircular hydrophilic recess 51 and the corresponding discharging outlet is desired to be in the range of from 35 μm to 200 μm. As for the width of each semicircular recess 51, it is desired to be in the range of from 100 μm to 400 μm in order for each semicircular recess to effectively exhibit its ink taking-up performance.

As apparent from the above description, the ink jet head provided with an improved discharging outlet face according to the present invention is free of the problems of causing defective printing due to mobile ink mists deposited in the vicinity of the discharging outlets in the prior art, wherein there are provided prominent advantages, which are hardly expected from the conventional water repellent constitution for a discharging outlet face of an ink jet head, such that ink droplets present on the discharging outlet face are entirely and surely divided so that they are not moved toward the discharging outlets by the foregoing specific hydrophilic zones and they are taken into the hydrophilic zones, and thus, such ink droplets are always surely prevented from arriving at the discharging outlets, whereby the discharging outlets are always maintained in a desirable state without being filled with ink droplets and the discharging outlets are ensured to exhibit their ink discharging performance as desired.

The ink mists and ink droplets immobilized by the foregoing hydrophilic zones can be effectively removed upon conducting the cleaning operation. This situation will be described with reference to FIG. 14 which illustrates an embodiment of cleaning the discharging outlet face by means of an edge 12 of a cleaning blade 11.

As shown in the figure, the cleaning blade 11 is moved in the direction expressed by an arrow mark while contacting to a discharging outlet face 8 of a discharging outlet-forming plate of an ink jet head through the edge of the cleaning blade in order to conduct cleaning of the discharging outlet face, wherein ink mists or/and ink droplets present in belt-like shaped, recessed hydrophilic zones 5 disposed in the discharging outlet face 8 and on a central water repellent zone E surrounding a plurality of discharging outlets 4 spacedly arranged in the discharging outlet face are removed. Particularly, when the ink jet head is moved while scanning, the cleaning blade 11 is slidably moved along the discharging outlet face 8 while being contacted thereto through the edge in the direction expressed by the arrow mark in synchronism with the movement of the ink jet head, wherein ink droplets maintained in the belt-like shaped, recessed hydrophilic zones 5 are raked up and withdrawn therefrom by the edge 12 of the cleaning blade. In this process, the ink droplets thus withdrawn successively move while gathering ink mists present on the central water repellent zone E to form a large-sized ink droplet 10. Thus, ink droplets deposited on the discharging outlet face 8 are successively moved in this way and they are wiped off by means of the cleaning blade 11. In this case, the ink droplets to be wiped off are extremely large in size and because of this, when these ink droplets having an extremely large size pass through the arrangement of the discharging outlets 4 together with the cleaning blade, there is no occasion for them to get into the discharging outlets because their extremely large surface tension.

An ink jet head provide with an improved discharging outlet face having the foregoing specific hydrophilic zones can be properly prepared in a conventional manner, for instance, a manner described in FIG. 4.

Firstly, a grooved top plate 3 integrally provided with a portion dedicated for forming a liquid chamber (not shown in the figure), liquid pathways 31 and a discharging outlet-forming plate 1 is produced by the conventional injection molding technique (Step 1, see S1 in the figure). Wherein, reference numeral 1A indicates the surface of the discharging outlet forming plate and reference numeral 1B indicates a backside of said plate. The discharging outlet-forming plate herein is provided with 64 discharging outlets spacedly arranged at an arrangement density of 360 dpi (the term dpi represents dot per inch).

The surface 1A (that is, the discharging outlet face) of the discharging outlet-forming plate 1 of the grooved top plate 3 thus obtained is then applied with water repelling treatment using a water repellent material (Step 2, see S2 in the figure). As for the area where the water repellent material is applied, it is not extended to the entire of the discharging outlet face but is limited to a predetermined area including the area where a cap is to be contacted. This is for preventing the water repellent material from reaching the backside upon applying the water repellent material or upon drying the water repellent material applied. For instance, in the case where the cap contacting areas A, B and C are situated respectively at a position which is 0.6 mm distant from the corresponding edge of the discharging outlet face as shown in FIG. 5, the water repellent material application area is extended to a limited of each of the cap contacting areas A, B and C which is 0.5 mm distant from the corresponding edge of the discharging outlet face. In the case where there is no fear for the water repellent material to extend to the backside, the water repellent material may be applied over the entire of the discharging outlet face.

In this embodiment, the water repellent material is applied to the discharging outlet face at a thickness of 0.1 μm to 0.2 μm by means of the transfer coating technique. The application of the water repellent material may be conducted by other conventional coating techniques such as the roll coating technique.

The thickness of the water repellent material applied is not always limited to the above range. It may be properly changed if necessary. However, in that case, when it is excessively thin, a satisfactory water repelling effect cannot be attained. On the other hand, when it is excessively thick, there is a fear for the water repellent material applied to be removed, for example, upon conducting the cleaning operation.

Then, the discharging outlet face of the discharging outlet-forming plate 1 of the grooved top plate 3, said discharging outlet face having been applied with the water repellent material in the second step, is subjected to heat treatment whereby the water repellent material is hardened into a water repellent film. Successively, a patterning mask (MS) provided with apertures corresponding to the patterns of given belt-like shaped, recessed hydrophilic zones and given island-like hydrophilic recesses is disposed on the surface of the water repellent film formed on the discharging outlet face 1A of the discharging outlet-forming plate, followed by subjecting to irradiation of excimer laser beam (ELA) whereby belt-like shaped, recessed hydrophilic zones and island-like hydrophilic recesses are formed. (Step 3, see S3 in the figure)

In the above, the irradiation of the excimer laser beam is conducted under conditions of 200 mj/cm$^2$ and one pulse to several pulses when the water repellent film is of 0.1 to 0.2 μm in thickness.

Successively, excimer laser beam is irradiated to the resultant obtained in the third step through the backside 1B of the discharging outlet-forming plate 1 at an incidence angle θ in the range of 5° to 10° to thereby form a plurality of discharging outlets 4 (Step 4, see S4 in the figure). During this laser processing, carbon particles are often deposited on the discharging outlet face. However such carbon particles may be desirably removed by sticking an adhesive tape to the discharging outlet face having the carbon particles deposited thereon and peeling off the adhesive tape.

The grooved top plate 3 thus processed is joined to a substrate for an ink jet head (not shown) which includes heat generating resistors capable of generating thermal energy for discharging ink through the discharging outlets, whereby an ink jet head is obtained.

The grooved top plate 3 is required to be constituted by a specific material which excels in moldability and ink-contacting property. In the present invention, the groove top plate is constituted by a polysulfone materia which exhibits a good hydrophilic property against ink and which is of about 60° in terms of the contact angle against ink.

As the water repellent material used in order to form the foregoing water repellent film, there can be mentioned polymers having a principal chain provided with a fluorine-containing heterocyclic structure such as commercially available CYTOP CTX-105 (trademark name, produced by Asahi Glass Co., Ltd.) and CYTOP CTX-805 (trademark name, produced by Asahi Glass Co., Ltd.); block copolymers of fluoro-olefine and vinyl-ether such as commercially available LUMIFLON (trademark name, produced by Asahi Glass Co., Ltd.), FLUONATE (trademark name, produced by Dainippon Ink and Chemicals Inc.), CEFRALCOAT (trademark name, produced by Central Glass CO., Ltd.), C-1 (Daikin Glass Co., Ltd.), TRIFLON (trademark name, produced by Mitsui Petrochemical & Glass Industries, Ltd.) and KYNARSL/KYNAR-ADS (ATOCHEM Company); photo-radical polymerization type fluorine-contained resin compositions consisting of reactive oligomer and reactive diluent monomer such as commercially available DEFENSA (trademark name, produced by ATOCHEM Company); comb-shaped fluoro copolymers such as commercially available LF-40 (trademark name, produced by Sohken-Kagaku Kabushiki Kaisha); fluoro silicones such as commercially available KP801M (trademark name, produced by Shin-Etsu Chemical Co., Ltd.); and perfluoro cyclo-polymers such as commercially available TeflonAF (trademark name, produced by Du Pont Company). Of these materials, said CYTOP CTX-105 is the most desirable. Incidentally, the CYTOP CTX-105 is about 70° in terms of the ink contact angle.

In the present invention, it is desired to selectively use the above water repellent materials so that a distinct relative difference of 10° or more is attained between the contact angle of ink against the water repellent area and that against the hydrophilic area.

In the following, description will be made of the conditions for the foregoing recessed hydrophilic zones 5 and outer hydrophilic zones 6 to be formed in the discharging outlet face in the present invention.

It is desired for each recessed hydrophilic zone 5 to be formed such that it is situated in parallel to the arrangement of the discharging outlets while maintaining a predetermined distance H from the arrangement of the discharging outlets. As for the recessed hydrophilic zones 5 thus formed, it is important for the distances H1 and H2 shown in FIG. 5 each indicating a distance between the corresponding recessed hydrophilic zone 5 and the arrangement of the discharging outlets and the widths W1 and W2 shown in FIG. 5 each indicating a width of the corresponding recessed hydrophilic zone to be properly designed so that the discharging outlets exhibit their discharging performance as desired without causing defective discharging due to ink mists deposited on the discharging outlet face.

In the case where any of the distances H1 and H2 between the respective recessed hydrophilic zones 5 and the arrangement of the discharging outlets 4 is made to be excessively narrow, when an ink droplet with a relatively large size in terms of the diameter is present on the central water repellent zone E of the discharging outlet face 8, there is a fear that such ink droplet serve to connect some of the discharging outlets 4 and the recessed hydrophilic zone 5 by means of the ink droplet, resulting in guiding the ink droplets maintained in the recessed hydrophilic zone 5 to the discharging outlets 4. This situation wherein ink droplets are guided to the discharging outlets is somewhat different depending upon the bore of the discharging outlets 4.

In any case, it is necessary for any of the distances H1 and H2 between the respective recessed hydrophilic zones 5 and the arrangement of the discharging outlets 4 to be made greater than the bore of the discharging outlets. However, as for the distances H1 and H2 between the respective recessed hydrophilic zones 5 and the arrangement of the discharging outlets 4, when they are excessively great, there is a fear that ink mists deposited on the central water repellent zone E gather to provide readily mobile ink droplets of larger than 100 μm in diameter and these ink droplets readily move to arrive at some of the discharging outlets 4, resulting in disabling the discharging outlets in termes of their discharging performance. Therefore, any of the above distances is designed such that those ink mists deposited on the central water repellent zone are readily taken into the recessed hydrophilic zones 5.

Any of the distances H1 and H2 which satisfies the above described conditions is desired to be of a value corresponding to about 1.2 holds to 3.5 holds over the bore of the discharging outlets. Specifically, any of the distances is made to be about 35 to 110 μm when the bore of the discharging outlets is about 30 μm. In the case where any of the distances is determined in this range, the above described ink mists are effectively taken up by and maintained in the recessed hydrophilic zones 5 without allowing them to arrive at the discharging outlets.

As for the widths W1 and W2 of the respective recessed hydrophilic zones 5, they should not be excessively narrowed in order for the respective recessed hydrophilic zones to be dedicated to effectively take in and maintain ink mists deposited on the discharging outlet face. Particularly, when these widths are smaller than 100 μm which corresponds the minimum diameter of a mobile ink droplet, the respective recessed hydrophilic zones are insufficient in termes of their performance of taking in mobile ink droplets. Therefore, The widths W1 and W2 are are desired to be greater than 100 μm in termes their lower limit. In addition, when the widths W1 and W2 are excessively large, the respective recessed hydrophilic zones are satisfactory in terms of taking in and maintaining mobile ink droplets on the discharging outlet face but a problem entails in that the respective recessed hydrophilic zones are excessively extended over the discharging outlet face. Thus, there is an upper limit for the widths W1 and W2. Specifically, the widths W1 and W2 of the respective recessed hydrophilic zones are desired to be made 400 μm or less in terms of their upper limit, while having a due care so that ink droplets present on the discharging outlet face by way of the cleaning operation. Additionally saying, when the respective recessed hydrophilic zones 5 are of a width exceeding said upper limit, ink residues are sometimes remained in the recessed hydrophilic zones without being removed upon conducting the cleaning operation, wherein the recessed hydrophilic zones having such ink residues therein should be left as they are over a long period of time, they eventually become not to exhibit their performance as desired.

In the following, description will be made of the experiments conducted by the present inventors in order to find out preferable conditions as for the foregoing outer hydrophilic zones.

Experiment 1

In this experiment, there were prepared six ink jet head samples in accordance with the foregoing manner of preparing an ink jet head, each ink jet head sample having a discharging outlet face with only two island-like patterned hydrophilic zones each being arranged on one of the opposite outsides of the arrangement of discharging outlets in said discharging outlet face wherein each island-like patterned hydrophilic zone comprises a water repellent zone containing a plurality of small hydrophilic recesses spacedly disposed while maintaining a predetermined distance L between each adjacent small hydrophilic recesses therein. The distance L was made different as for each ink jet head sample.

The small hydrophilic recesses of the island-like patterned hydrophilic zone comprises small recesses formed at given respective intersection points of an apparent square framing pattern with a pitch of 0.4 mm in a given water repellent area of the discharging outlet face. The above distance L means a distance between each adjacent small hydrophilic recesses.

The six ink jet head samples, i.e., Samples Nos. 1 to 6, were made different from each other with respect to the distance L as shown in Table 1. As for each of the six ink jet head samples, there were prepared five ink jet heads.

As for each of the six ink jet head samples, each of the five ink jet heads was subjected to printing operation at a driving frequency of 6.2 KHz, wherein ink was discharged from all the discharging outlets to print solid characters in 60 lines on a A4 size recording paper, and this printing operation was continuously conducted five times without cleaning the discharging outlet face.

The five printed papers thus obtained were optically observed of whether or not they are accompanied by white lines occurred due to some of the discharging outlets having been filled up with ink upon the ink discharging. The observed results were evaluated based on the following criteria. And the evaluated results obtained are collectively shown in the table.

○: the case wherein all the five ink jet heads provided high quality prints,

Δ: the case where of the five ink jet heads, one to four of them provided satisfactory prints, and X: the case where all the five ink jet heads caused defects in ink discharging as for some of their discharging outlets.

Based on the results obtained, there was obtained a finding that it is desirable for the foregoing distance L to be in the range of from 65 μm to 200 μm.

Experiment 2

In this experiment, there were prepared six ink jet head samples in accordance with the foregoing manner of preparing an ink jet head, each ink jet head sample having a discharging outlet face with only two island-like patterned hydrophilic zones each being arranged on one of the opposite outsides of the arrangement of discharging outlets in said discharging outlet face wherein each island-like patterned hydrophilic zone comprises a water repellent zone containing a plurality of small hydrophilic recesses with a given area S spacedly disposed therein. The area S was made different as for each ink jet head sample.

The hydrophilic recesses of the island-like patterned hydrophilic zone comprises small recesses formed at respective intersection points of an apparent square framing pattern with a pitch of 0.4 mm in a given water repellent area of the discharging outlet face. The above area S means an area of each of the small recesses formed at respective intersection points of the above square framing pattern.

The six ink jet head samples, i.e., Samples Nos. 7 to 12, were made different from each other with respect to the area S as shown in Table 2. As for each of the six ink jet head samples, there were prepared five ink jet heads.

As for each of the six ink jet head samples, each of the five ink jet heads was subjected to printing operation in the same manner as in Experiment 1.

The five printed papers thus obtained were optically observed of whether or not they are accompanied by white lines occurred due to some of the discharging outlets having been filled up with ink upon the ink discharging. The observed results were evaluated based on the following criteria. And the evaluated results obtained are collectively shown in the table.

○: the case wherein all the five ink jet heads provided high quality prints,

Δ: the case where of the five ink jet heads, one to four of them provided satisfactory prints, and X: the case where all the five ink jet heads caused defects in ink discharging as for some of their discharging outlets.

Based on the results obtained, there was obtained a finding that it is desirable for the foregoing area S to be in the range of from 0.10 $mm^2$ to 0.25 $mm^2$.

Experiment 3

In this experiment, there were prepared six ink jet head samples in accordance with the foregoing manner of preparing an ink jet head, each ink jet head sample having a discharging outlet face with only two island-like patterned hydrophilic zones each being arranged on one of the opposite outsides of the arrangement of discharging outlets in said discharging outlet face wherein each island-like patterned hydrophilic zone comprises a water repellent zone containing a plurality of small hydrophilic recesses spacedly disposed therein at a give distribution density per unit area. Said distribution density of the small hydrophilic recesses was made different as for each ink jet head sample.

The six ink jet head samples, i.e., Samples Nos. 13 to 18, were made different from each other with respect to the distribution density of the small hydrophilic recesses distributed per unit area as shown in Table 2. As for each of the six ink jet head samples, there were prepared five ink jet heads.

As for each of the six ink jet head samples, each of the five ink jet heads was subjected to printing operation in the same manner as in Experiment 1.

The five printed papers thus obtained were optically observed of whether or not they are accompanied by white lines occurred due to some of the discharging outlets having been filled up with ink upon the ink discharging. The observed results were evaluated based on the following criteria. And the evaluated results obtained are collectively shown in the table.

○: the case wherein all the five ink jet heads provided high quality prints,

Δ: the case where of the five ink jet heads, one to four of them provided satisfactory prints, and X: the case where all the five ink jet heads caused defects in ink discharging as for some of their discharging outlets.

Based on the results obtained, there was obtained a finding that it is desirable for the foregoing distribution density of the small hydrophilic recesses per unit area to be in the range of from 35% to 65%.

In the present invention, in connection with the foregoing central water repellent zone, one or more specific hydrophilic zones may be formed in any of the foregoing patterns as long as the above experimentally confirmed conditions are satisfied, wherein a highly reliable ink jet head is afforded in any case.

An ink jet head according to the present invention, having a discharging outlet face having been processed as above described may be desirably mounted to such an ink jet apparatus as will be described below, wherein desirable printing can be conducted by applying a printing signal.

FIG. 15 is a schematic view illustrating the constitution of an ink jet apparatus in which an ink jet head according to the present invention is installed.

In the ink jet apparatus shown in FIG. 15, a lead screw 5005 rotates by way of drive transmission gears 5001 and 5009 by the forward and backward rotation of a driving motor 5013. The lead screw has a helical groove 5004 with which a pin (not shown) of a carriage HC is engaged, by which the carriage HC is reciprocable in directions a and b. The carriage has an ink jet cartridge IJC mounted thereon. Reference numeral 5002 indicates a sheet confining plate which serves to confine a printing sheet on a platen 5000 along the direction of the carriage HC to move. Each of reference numerals 5007 and 5008 indicates a photocoupler which serves as a home position detecting means for detecting the presence of a lever 5006 of the carriage in this area and switching the rotational direction of the driving motor 5013. Reference numeral 5016 indicates a supporting member for supporting a capping member 5022 which serves to cap the front face of the ink jet head head. Reference numeral 5015 indicates a suction means for sucking the inside of the capping means and which serves to perform recovery of the ink jet head through an internal opening 5023 of the capping means.

Reference numeral 5017 indicates a cleaning blade. Reference numeral 5019 indicates a moving member which serves to enable the cleaning blade to movie in the forward or backward direction. These means are supported by a main body supporting plate 5018. The cleaning blade is not limited only to this configuration, but a conventional cleaning blade can be used.

Reference numeral 5012 indicates a lever for commencing the suction recovery operation. Reference numeral 5020 indicates a cam. The cam contacts with a part of the carriage HC when the carriage arrives at the home position, and as a result, the cam is moved to the left hand side in the figure, wherein the cam is brought into mesh with the driving gear 5009 whereby changing the transfer route.

The system of the above ink jet apparatus is designed such that each of the capping, cleaning, and suction recovery operations can be properly conducted by the action of the lead screw 5005 at an appropriate corresponding position when the carriage HC moves in the region on the home position side. Other than this, the system may be designed such that these operations can be conducted with the conventional timing.

The printing, recovery and the like operations in the above described ink jet apparatus are controlled by such control mechanism as shown in a block diagram of FIG. 16.

In the figure, reference numeral 176 indicates a CPU, i.e., a central processing unit, containing an interface into which an external printing signal is inputted. The CPU stores a program ROM containing programs for controlling the system and various data (including data relating to the printing and printing data supplied to the ink jet head). The CPU further stores a dynamic type RAM capable of memorizing the number of the printing dots and the frequency of the ink jet head to have been replaced by a new one.

Reference numeral 172 indicates a driving means containing a gate array which serves to control the supply of printing data to the ink jet head 173, and it also serves to drive the ink jet head based on the data from the interface, ROM and RAM. Reference numeral 171 indicates a frequency controller which serves to change the driving frequency for the driving means 172. In this embodiment, the high speed driving frequency and ordinary printing frequency are properly controlled.

Reference numeral 174 indicates a cleaning means (which will be occasionally called a cleaning blade in the following), and it operates upon the arrival of the ink jet head at a given cleaning position to clean the discharging outlet face of the ink jet head. Reference numeral 175 indicates a means for cleaning the cleaning blade before the cleaning blade is used for cleaning the discharging outlet face of the ink jet head or after it has been used for cleaning the discharging outlet face of the ink jet head. Reference numeral 177 indicates a capping means which serves to perform capping for the discharging outlet face of the ink jet head when an inconvenience is occurred in the data processing or the like during the printing operation or when the suction recovery operation is conducted for the ink jet head or when the ink jet head is in the stand-by condition.

In the following, description will be made of the interrelations among the ink jet head, capping means and cleaning means in the above.

FIG. 17 schematically shows an embodiment of cleaning the cleaning blade prior to subjecting it to clean the discharging outlet face of the ink jet head IJH, an embodiment of cleaning the the discharging outlet face of the ink jet head, and an embodiment of contacting the capping means to the discharging outlet face of the ink jet head upon the suction recovery operation. The relative positional relationships of the capping means 177 and the cleaning means 174 are not limited only to those shown in the figure.

In the following, description will be made of the embodiments shown in the figure. It should be understood that the ink jet head in the following description is one with a discharging outlet face having the foregoing surface configuration shown in FIG. 3.

From the figure, it is understood that as the ink jet head IJH is moving toward a given home position after having served for the printing operation, the cleaning blade 174 comes to rubb the discharging outlet face of the ink jet head IJH to thereby clean the discharging outlet face. In this case, the cleaning blade 174 is first contacted with a side face 175 of the ink jet head IJH, and thereafter, it is moved along the direction of the ink jet head IJH to move wherein it is engaged in cleaning the discharging outlet face of the ink jet head, wherein the cleaning operation for the discharging outlet face of the ink jet head is conducted in the order of the first outer hydrophilic zone B1, the first belt-like shaped, recessed hydrophilic zone C1, the central water repellent zone E, the second belt-like shaped, recessed hydrophilic zone C2, and the second outer hydrophilic zone B2.

In the above, the cleaning face of the cleaning blade 174 is firstly rubbed with the side face 175 of the ink jet head IJH as above described. By this, ink deposits on the cleaning face of the cleaning blade 174 which have been transferred from the discharging outlet face of the ink jet head upon cleaning the discharging outlet face of the ink jet head are desirably removed and the cleaning face of the cleaning blade is therefore maintained in a cleaned state upon subjecting it to cleaning the discharging outlet face of the ink jet head. Thus, the discharging outlet face of the ink jet head is well cleaned as desired.

Incidentally, the side face 175 of the ink jet head IJH with which the cleaning blade 174 is to be rubbed may be provided with an additional member such as an aluminum plate or an absorbent material on the surface thereof. In this case, an improvement is attained in the cleaning efficiency thereof for the cleaning blade.

After the discharging outlet face of the ink jet head is cleaned in the way above described, a capping means 177B is contacted to the discharging outlet face of the ink jet head IJH to protect said discharging outlet face. Then a suction pump 177C, which is connected to the capping means 177B, is actuated to conduct suction recovery for the discharging outlets of the ink jet head, wherein ink withdrawn from the discharging outlets are taken up by an absorbent material 177A disposed in the capping means 177B.

It is possible for the above cleaning operation to be conducted prior to subjecting the ink jet head for which the suction recovery treatment using the capping means has been conducted to successive printing operation. In this case, ink deposits possibly caused on the discharging outlet face upon conducting the suction recovery treatment can be desirably removed so that high quality printing can be always attained.

EXAMPLES

The present invention will be described in more detail with reference to the following examples, which are provided here for illustrative purposes only, and are not intended to limit the scope of the present invention.

Example 1

Using polysulfone, there was prepared a grooved top plate 3 provided with 64 nozzles at an arrangement density of 360 dpi by the conventional injection molding technique. Then, a water repellent material comprising CYTOP CTX-105 was applied onto substantially the entire area of the surface (that is, the discharging outlet face) of the grooved top plate at a thickness of 0.1 μm by the conventional transfer coating technique. The grooved top plate 3 having the discharging outlet face applied with the water repellent material was subjected to heat treatment to harden the applied water repellent material, whereby a water repellent film 1 was formed. Thereafter, excimer laser beam was irradiated to the discharging outlet face through a patterning mask provided with specific apertures satisfying conditions of providing such hydrophilic zones as shown in FIG. 5 which are 0.4 mm for each of W1 and W2, 0.05 mm for each of H1 and H2, and island-like distributed hexagonal hydrophilic recesses of 0.15 $mm^2$ in terms of the area of each hydrophilic recess and 40% in terms of the distribution density of the hydrophilic recesses per unit area. The irradiation of the excimer laser beam was conducted under conditions of 200 $mj/cm^2$ and one pulse. Then, excimer laser beam was irradiated to the resultant through the backside opposite the discharging outlet-forming face at an incident angle θ of 10°, to thereby form a plurality of discharging outlets.

The thus processed grooved top plate was joined to a substrate for an ink jet head, including heat generating resistors capable of generating thermal energy for discharging ink from the discharging outlets, whereby an ink jet head.

In this way, there were obtained five ink jet heads.

Example 2

The procedures of Example 1 were repeated, except that the patterning mask was replaced by a patterning mask provided with specific apertures satisfying conditions of providing such hydrophilic zones as shown in FIG. 8 which are 0.4 mm for W1, 0.05 mm for H1, and island-like distributed hexagonal hydrophilic recesses of 0.15 $mm^2$ in terms of the area of each hydrophilic recess and 40% in terms of the distribution density of the hydrophilic recesses per unit area, to thereby obtain five ink jet heads.

Comparative Example 1

The procedures of Example 1 were repeated, except that the application of the water repellent material was conducted to the entire area of the discharging outlet face) and no processing was conducted therefor, to thereby obtain five ink jet heads.

Comparative Example 2

The procedures of Example 1 were repeated, except that the discharging outlet face was remained in a so-called hydrophilic zone state without conducting any treatment therefor, to thereby obtain five ink jet heads.

As for each of the ink jet heads obtained in Example 1 and Comparative Examples 1 and 2, evaluation was conducted in the following manner. That is, each ink jet head was mounted in the foregoing ink jet apparatus. Using the ink jet apparatus, reciprocative printing was conducted at a driving frequency of 6.2 KHz, wherein ink was discharged from all the discharging outlets to print solid characters in 60 lines on a A4 size recording paper, and this printing operation was continuously conducted five times.

As for the ink jet heads obtained in Example 2, evaluation was conducted in the following manner. That is, each ink jet head was mounted in the foregoing ink jet apparatus. Using the ink jet apparatus, one-way printing was conducted at a driving frequency of 6.2 KHz, wherein ink was discharged from all the discharging outlets to print solid characters in 60 lines on a A4 size recording paper, and this printing operation was continuously conducted five times.

The five printed papers thus obtained in each case were optically observed of whether or not they are accompanied by white lines occurred due to some of the discharging outlets having been filled up with ink upon the ink discharging. The observed results were evaluated based on the following criteria. And the evaluated results obtained are collectively shown in Table 4.

○: the case wherein all the five ink jet heads provided high quality prints,

Δ: the case where of the five ink jet heads, one to four of them provided satisfactory prints, and X: the case where all the five ink jet heads caused defects in ink discharging as for some of their discharging outlets.

From the results obtained, it was found that any of the ink jet heads each having a specific discharging outlet face treated according to the present invention enables to conduct high quality printing without suffering from any influences due to ink mists deposited on the discharging outlet face even in the case of high frequency printing.

As above described, the present invention provides an ink jet head having an improved discharging outlet face provided with a plurality of discharging outlets spacedly arranged therein wherein said discharging outlet face contains a water repellent zone disposed so as to surround the arrangement of the discharging outlets, a belt-like shaped hydrophilic zone disposed in a region which is distant by a given distance from the arrangement of the discharging outlets, and another water repellent zone other than said water repellent zone around the arrangement of the discharging outlets, said another water repellent zone containing a plurality of small hydrophilic zones spacedly distributed therein. In the ink jet head according to the present invention, ink droplets caused on the discharging outlet face upon conducting printing by discharging ink from the discharging outlets are effectively taken into and maintained in the hydrophilic zone situated in the vicinity of the arrangement of the discharging outlets or they are moved toward a direction which is remote from the arrangement of the discharging outlets without causing growth of them. Because of this, the ink jet head according to the present invention enables to effectively prevent occurrence of contamination of foreign ink deposits caused on the discharging outlet face into ink discharged from the discharging outlets and also to effectively prevent the discharging outlets from being defective in terms of their discharging performance due to such foreign ink deposits whereby providing stably and continuously provide high quality and highly reliable prints even in the case where printing is conducted at an improved printing speed or/and at a high driving frequency. In addition, there are other advantages for the ink jet head according to the present invention such that the head itself possesses an improved durability, the water repellent portion of the head possesses an improved durability, the interval for the cleaning operation to be conducted can be prolonged, and the contact pressure of the cleaning means upon conducting the cleaning operation can be remarkably reduced.

The ink jet apparatus according to the present invention is desirably suited for high speed printing since the interval for the cleaning operation to be conducted can be remarkably prolonged.

TABLE 1

| Sample No. | L (μm) | first print | second print | third print | fourth print | fifth print |
|---|---|---|---|---|---|---|
| Sample No. 1 | 65 | ○ | ○ | ○ | Δ | Δ |
| Sample No. 2 | 135 | ○ | ○ | ○ | Δ | Δ |
| Sample No. 3 | 165 | ○ | ○ | Δ | Δ | Δ |
| Sample No. 4 | 200 | ○ | ○ | Δ | Δ | Δ |
| Sample No. 5 | 242 | ○ | x | x | x | x |
| Sample No. 6 | 265 | x | x | x | x | x |

TABLE 2

| Sample No. | S ($mm^2$) | first print | second print | third print | fourth print | fifth print |
|---|---|---|---|---|---|---|
| Sample No. 7 | 0.071 | x | x | x | x | x |
| Sample No. 8 | 0.080 | ○ | x | x | x | x |
| Sample No. 9 | 0.120 | ○ | ○ | Δ | Δ | Δ |
| Sample No. 10 | 0.190 | ○ | ○ | ○ | Δ | Δ |
| Sample No. 11 | 0.196 | ○ | ○ | ○ | Δ | Δ |
| Sample No. 12 | 0.240 | ○ | ○ | ○ | Δ | Δ |

TABLE 3

| Sample No. | distribution density (%) | first print | second print | third print | fourth print | fifth print |
|---|---|---|---|---|---|---|
| Sample No. 13 | 21.9 | x | x | x | x | x |
| Sample No. 14 | 25.0 | ○ | x | x | x | x |
| Sample No. 15 | 37.5 | ○ | ○ | Δ | Δ | Δ |
| Sample No. 16 | 40.6 | ○ | ○ | Δ | Δ | Δ |
| Sample No. 17 | 59.3 | ○ | ○ | ○ | Δ | Δ |

TABLE 3-continued

| Sample No. | distribution density (%) | first print | second print | third print | fourth print | fifth print |
|---|---|---|---|---|---|---|
| Sample No. 18 | 62.5 | ○ | ○ | ○ | Δ | Δ |

TABLE 4

| | first print | second print | third print | fourth print | fifth print |
|---|---|---|---|---|---|
| Example 1 | ○ | ○ | ○ | Δ | Δ |
| Example 2 | ○ | ○ | Δ | Δ | Δ |
| Comparative Example 1 | Δ | Δ | x | x | x |
| Comparative Example 2 | Δ | Δ | Δ | Δ | Δ |

Figure 1:
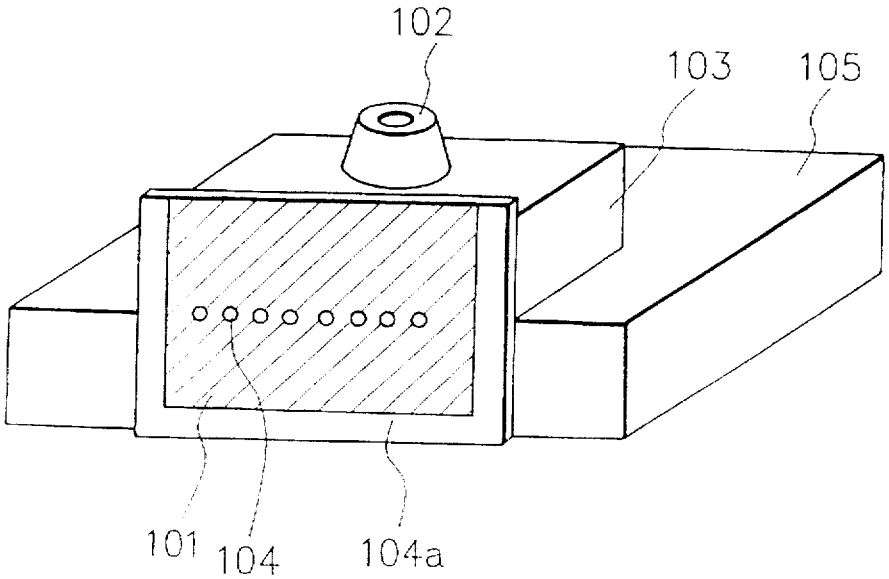
FIG. 1 is a schematic view illustrating the constitution of a conventional ink jet head having a discharging outlet face applied with water repelling treatment to the entire surface thereof.
Figure 2:
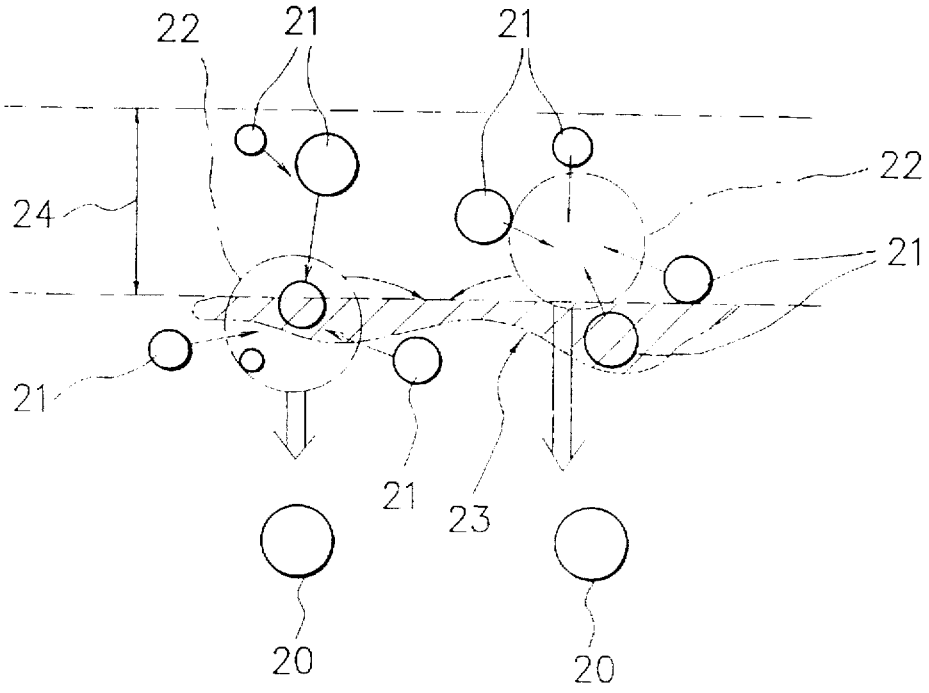
FIG. 2 is a schematic view for explaining the behavior of ink mists deposited on the discharging outlet face of the conventional ink jet head.
Figure 3:
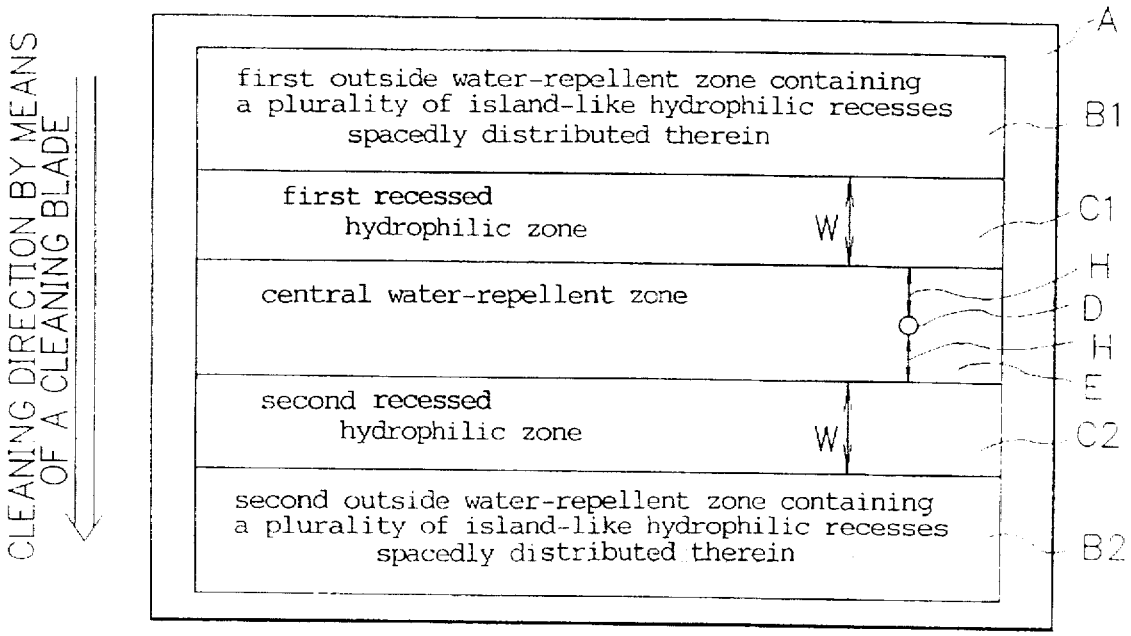
FIG. 3 is a schematic view illustrating the configuration of an embodiment of the surface state of a discharging outlet face in an ink jet head according to the present invention.
Figure 4:
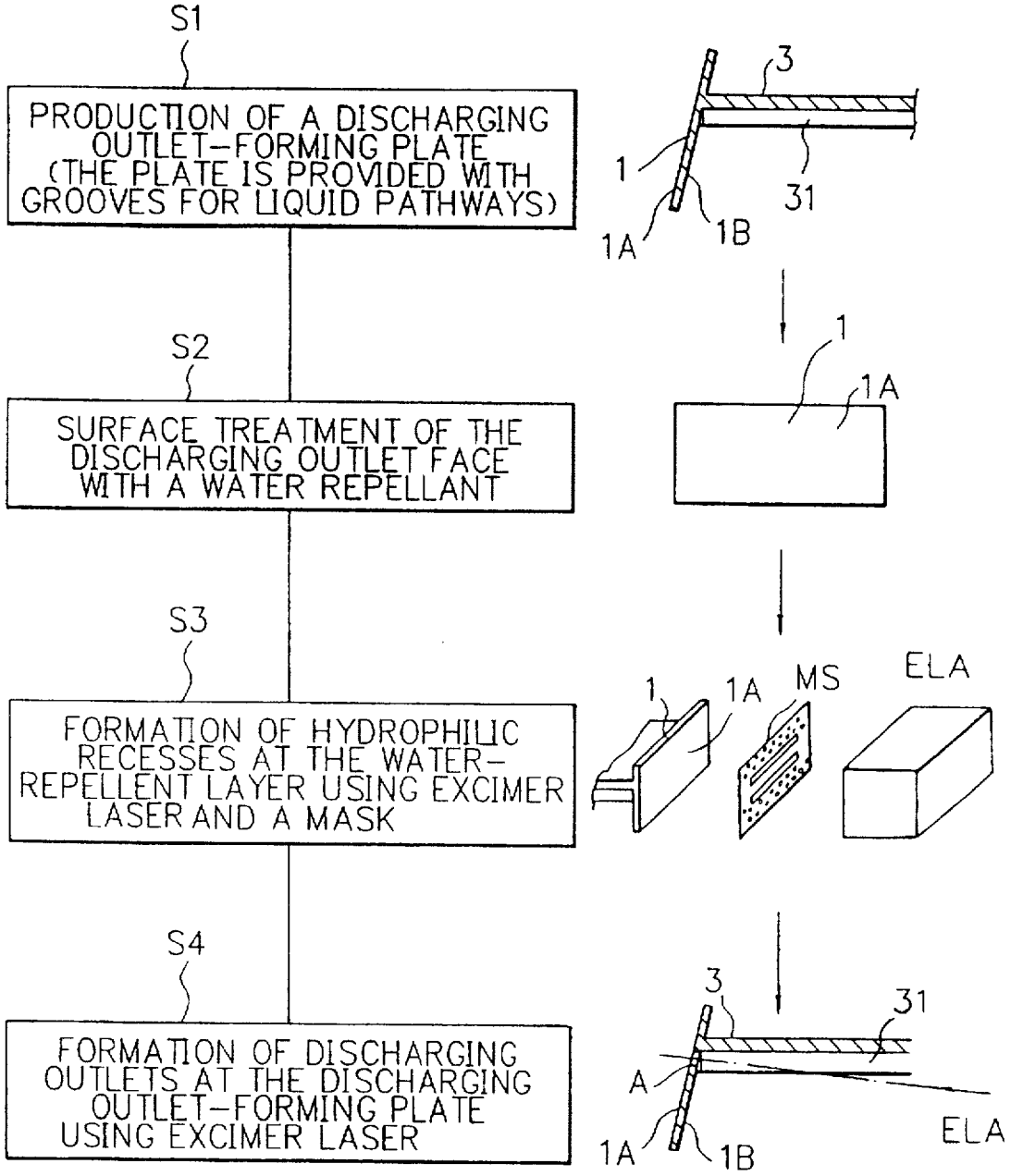
FIG. 4 shows a schematic flow chart of the steps of obtaining a surface-treated discharging outlet face for an ink jet head according to the present invention.
Figure 5:
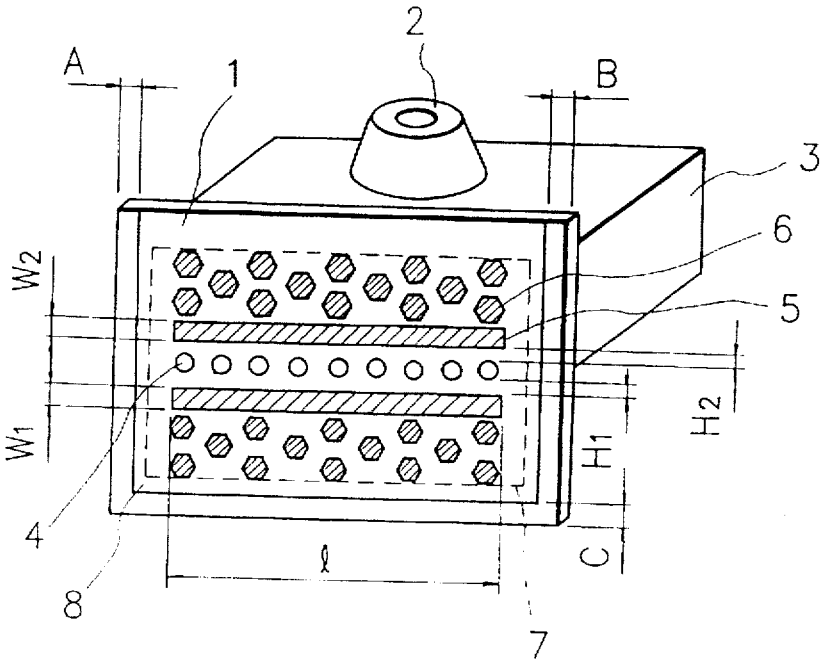
FIG. 5 is a schematic view illustrating a surface pattern example at a discharging outlet face in an ink jet head according to the present invention.
Figure 6:
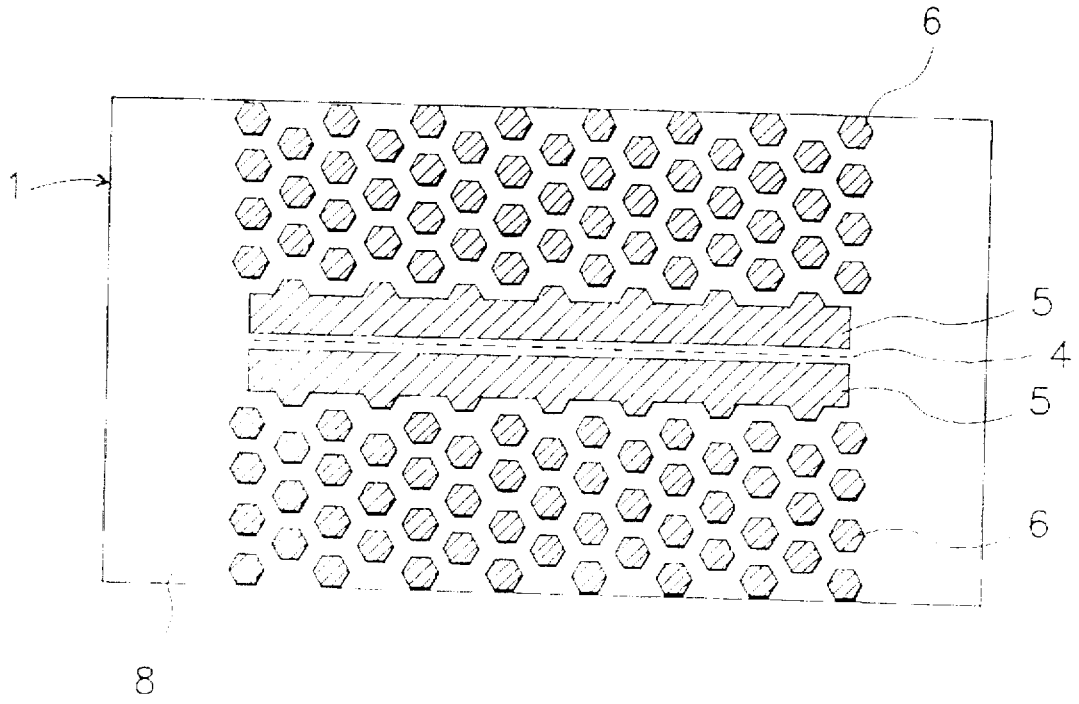
FIG. 6 is a schematic view illustrating another surface pattern example at a discharging outlet face in an ink jet head according to the present invention.
Figure 7:
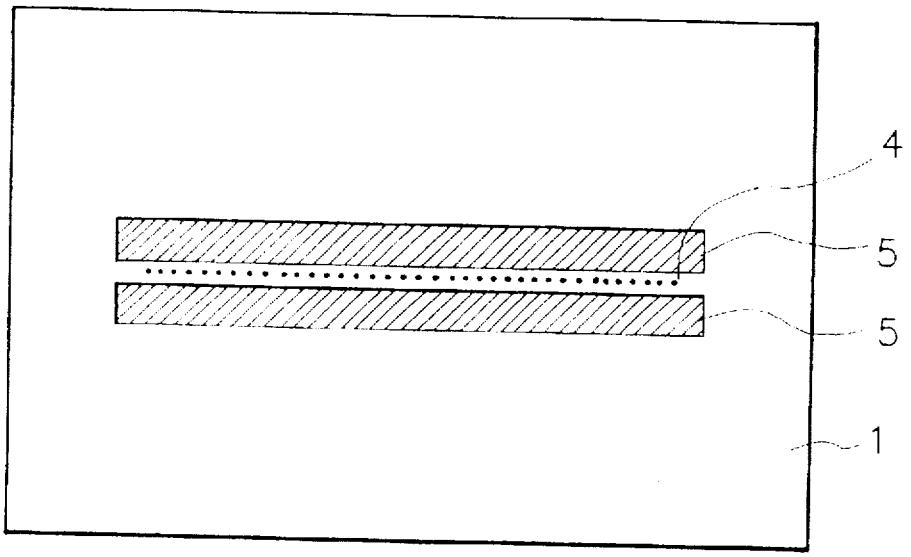
FIG. 7 is a schematic view illustrating a further surface pattern example at a discharging outlet face in an ink jet head according to the present invention.
Figure 8:
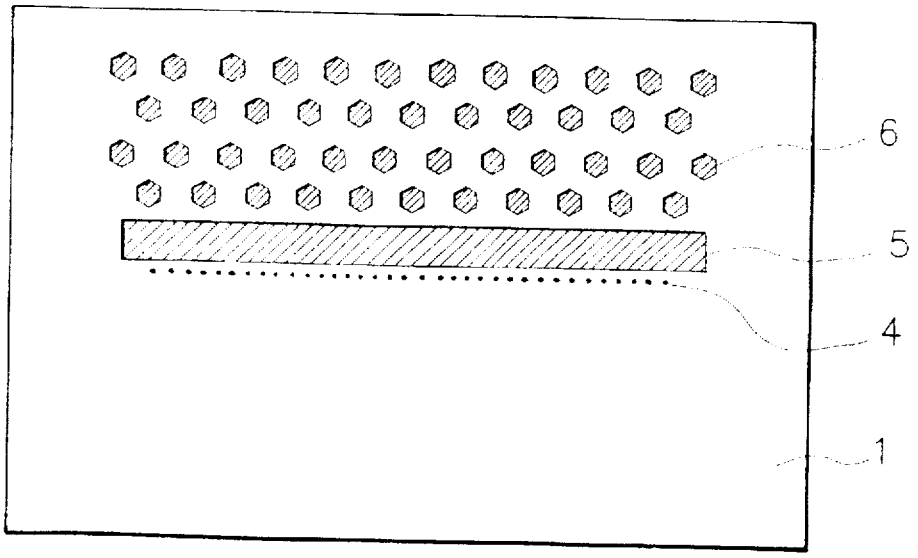
FIG. 8 is a schematic view illustrating a further surface pattern example at a discharging outlet face in an ink jet head according to the present invention.
Figure 9:
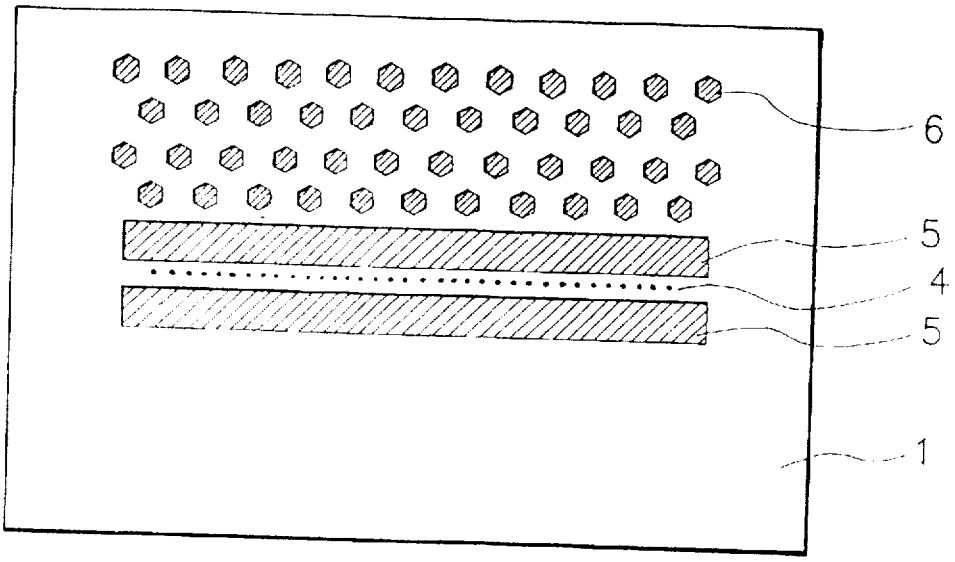
FIG. 9 is a schematic view illustrating a further surface pattern example at a discharging outlet face in an ink jet head according to the present invention.
Figure 10:
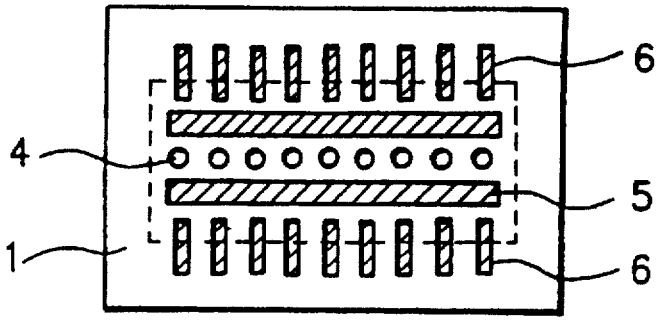
FIG. 10 is a schematic view illustrating a further surface pattern example at a discharging outlet face in an ink jet head according to the present invention.
Figure 11A:
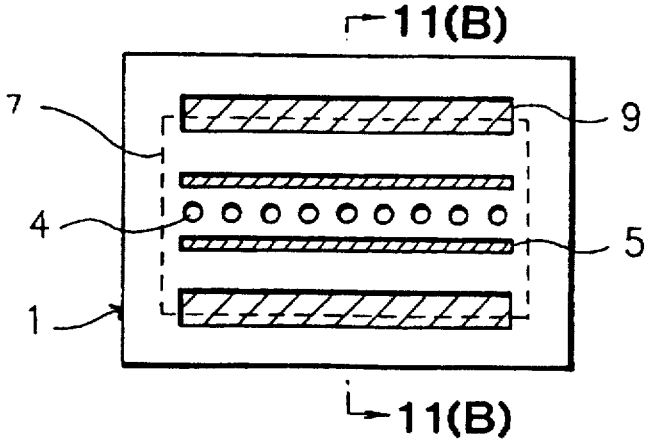
FIG. 11(A) is a schematic view illustrating a further surface pattern example at a discharging outlet face in an ink jet head according to the present invention.
Figure 11B:
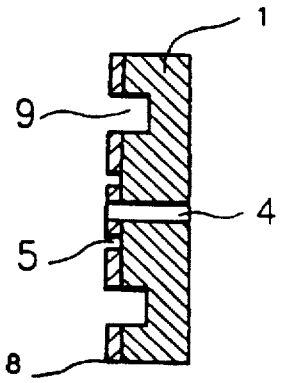
FIG. 11(B) is a schematic cross-sectional view, taken along line 11(B)—11(B) in FIG. 11(A).
Figure 12:
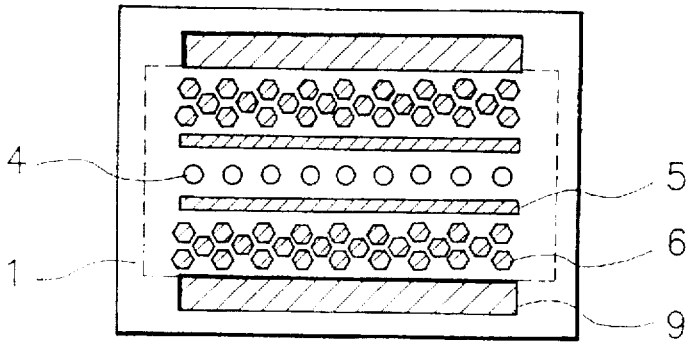
FIG. 12 is a schematic view illustrating a further surface pattern example at a discharging outlet face in an ink jet head according to the present invention.
Figure 13:
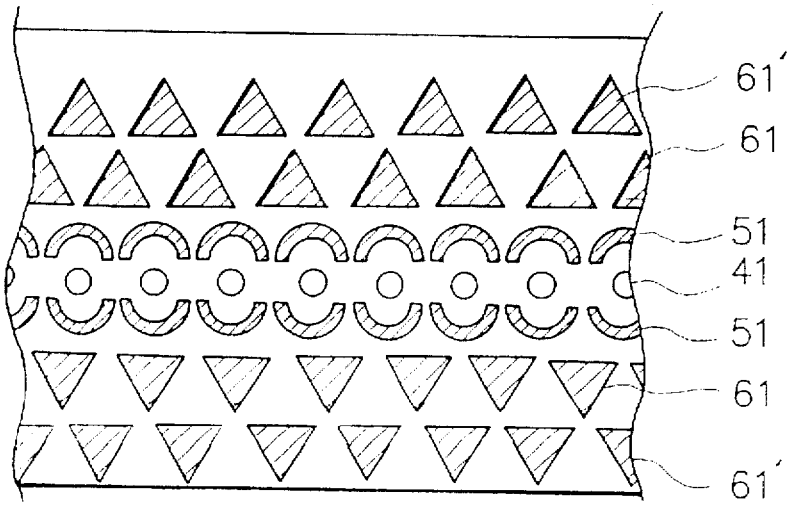
FIG. 13 is a schematic view illustrating a further surface pattern example at a discharging outlet face in an ink jet head according to the present invention.
Figure 14:
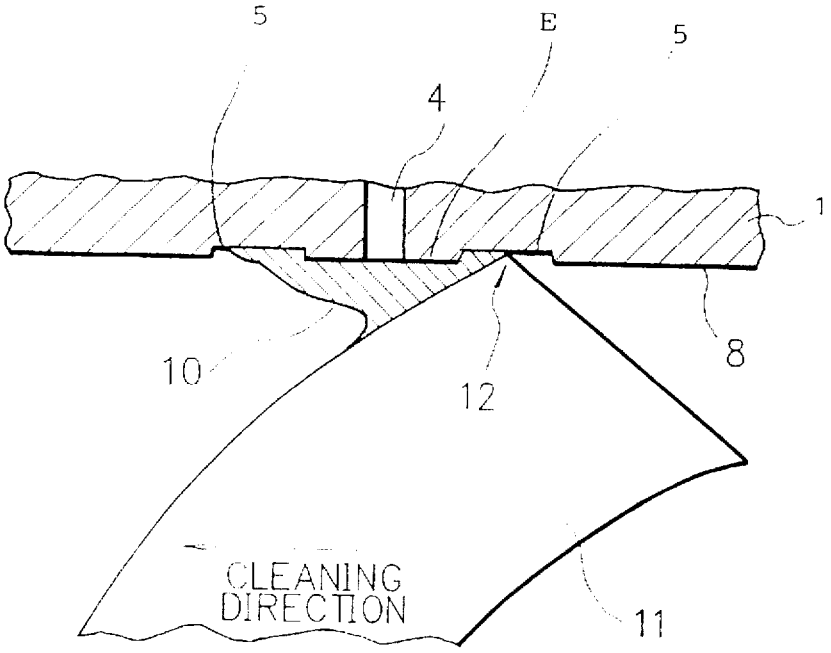
FIG. 14 is a schematic view for explaining the operation of cleaning the discharging outlet face of an ink jet head in the present invention.
Figure 15:
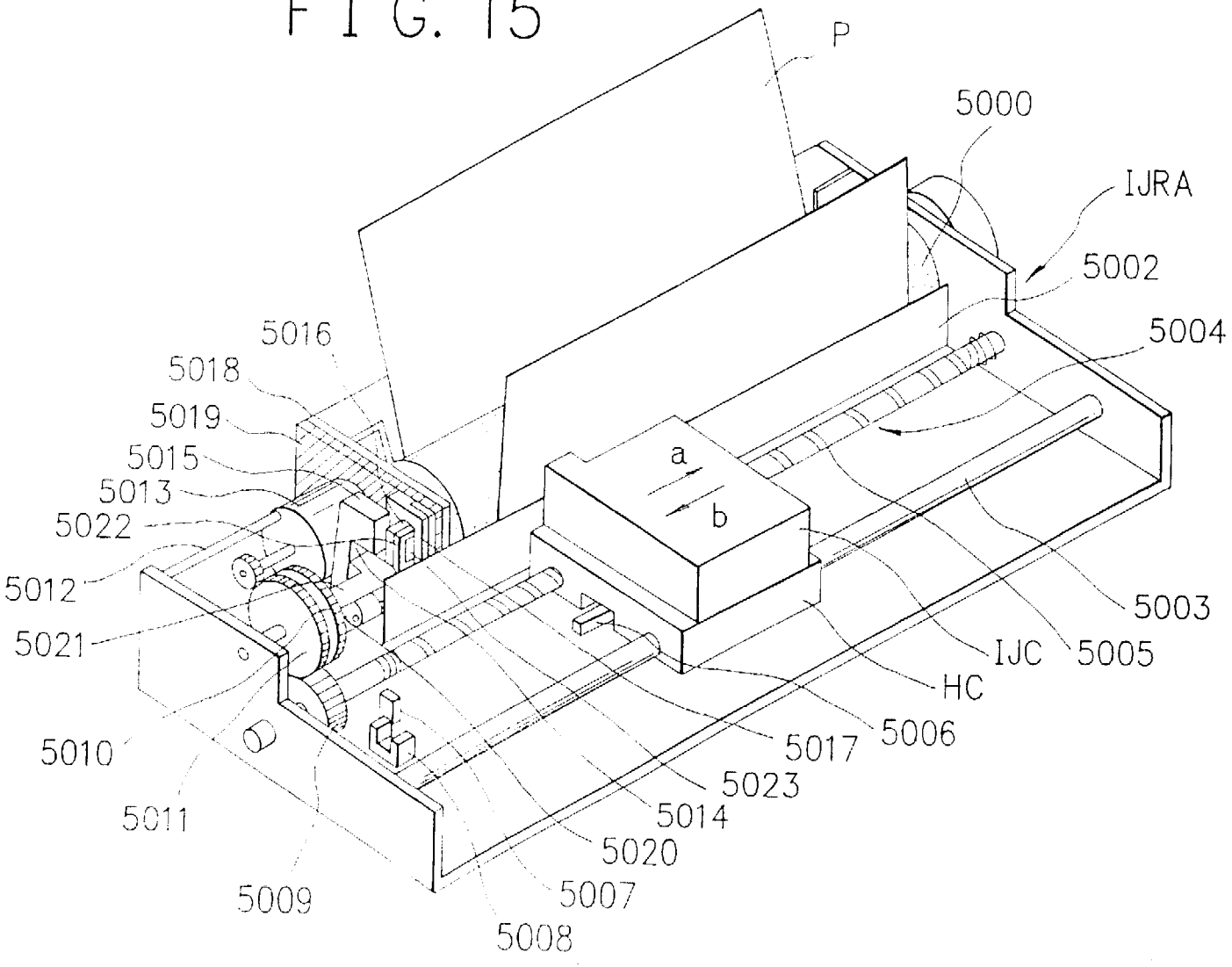
FIG. 15 is a schematic view illustrating the constitution of an ink jet apparatus in which an ink jet head according to the present invention is installed.
Figure 16:
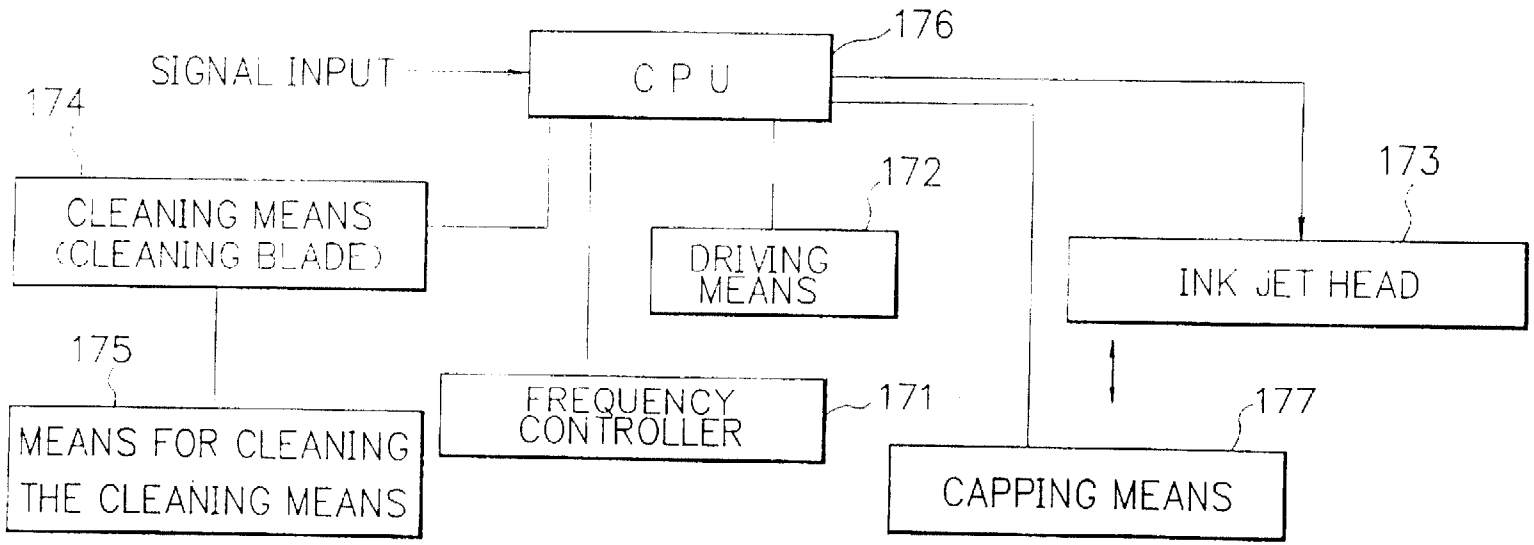
FIG. 16 is a schematic diagram illustrating a control mechanism controlling printing in an ink jet head apparatus in the present invention.
Figure 17:
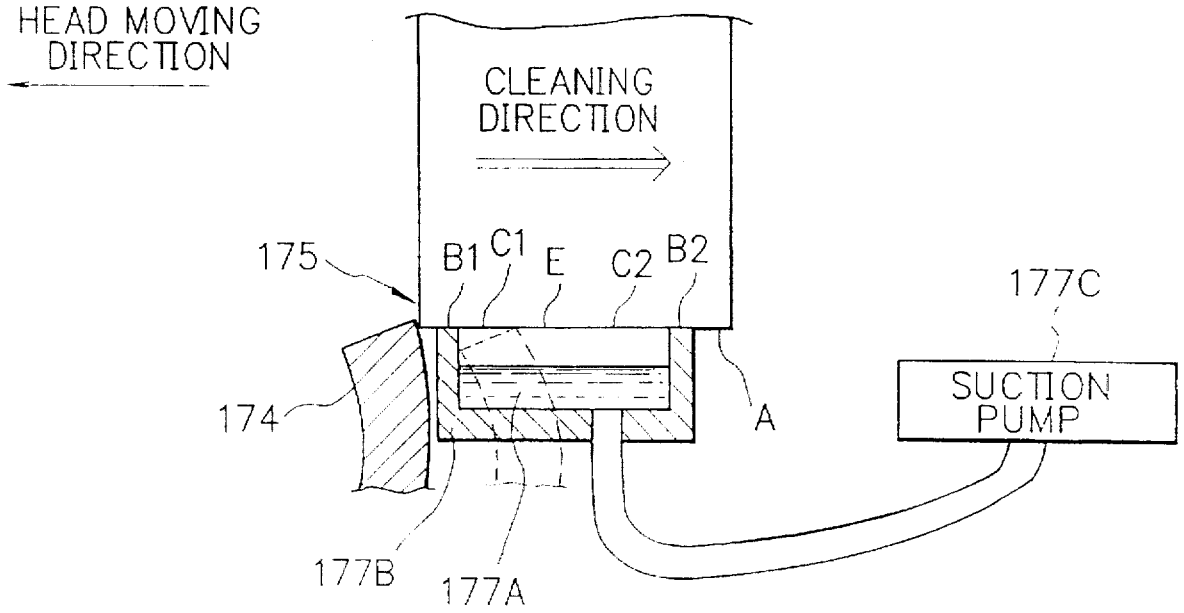
FIG. 17 is a schematic view for explaining the interrelations among an ink jet head, a capping means and a cleaning blade in an ink jet apparatus according to the present invention.

What is claimed is:

1. An ink jet head, comprising:

a plurality of discharging outlets disposed in an arrangement direction;

a plurality of ink pathways, each said ink pathway communicating with an associated said discharging outlet, each of said ink pathways having an energy generating element for generating energy for discharging an ink from said discharging outlet; and a discharging outlet face having a discharging outlet surface, said discharging outlets being arranged in said discharging outlet surface, a water-repellent discharging outlet peripheral region circumscribing said discharging outlets, and having a first side and a second side, and a discontinuous hydrophilic region containing a number of portions each having a hydrophilic nature relative to said discharging outlet peripheral region and which portions are spacedly distributed in said discontinuous hydrophilic region, said discontinuous hydrophilic region being positioned on at least one said side of said discharging outlet peripheral region, said discontinuous hydrophilic region being separated by a predetermined distance from said discharging outlet peripheral region.

2. An ink jet head according to claim 1, wherein the discontinuous hydrophilic region is situated on both said sides of the discharging outlet peripheral region.

3. An ink jet head according to claim 1, wherein the discharging outlet face further comprises a continuous hydrophilic region.

4. An ink jet head according to claim 3, wherein the continuous hydrophilic region is positioned between the water-repellent discharging outlet peripheral region and the discontinuous hydrophilic region.

5. An ink jet head according to claim 1, wherein the discontinuous hydrophilic region is provided in a recess formed in the discharging outlet face on at least one of the first and second sides.

6. An ink jet apparatus, comprising:

an ink jet head comprising;

a plurality of discharging outlets disposed in an arrangement direction, a plurality of ink pathways, each said ink pathway communicating with an associated said discharging outlet, each of said pathways having an energy generating element for generating energy for discharging an ink from said discharging outlet, a discharging outlet face having a discharging outlet surface, said discharging outlets being arranged in said discharging outlet surface, a water-repellent discharging outlet peripheral region circumscribing said discharging outlets, and having a first side and a second side, and a discontinuous hydrophilic region containing a number of portions having a hydrophilic nature relative to said discharging outlet peripheral region and which portions are spacedly distributed in said discontinuous hydrophilic region, said discontinuous hydrophilic region being positioned on at least one said side of said discharging outlet peripheral region, said discontinuous hydrophilic region being separated by a predetermined distance from said discharging outlet peripheral region; and a cleaning blade for wiping and thereby cleaning said discharging outlet face as a consequence of relative movement with said discharging outlet face.

7. An ink jet apparatus according to claim 6, wherein said discontinuous hydrophilic region situated in the discharging outlet face is located on a downstream side of said discharging outlet face as determined in accordance with relative movement of the cleaning blade as it wipes the discharging outlet face.

8. An ink jet apparatus according to claim 6, further comprising a capping means for capping and thereby protecting the discharging outlets, said capping means also being used in a recovery of the discharging outlets so as to restore their discharging performance.

9. An ink jet apparatus, comprising:

an ink jet head comprising;

a plurality of discharging outlets disposed in an arrangement direction, a plurality of ink pathways, each said ink pathway communicating with an associated said discharging outlet, each of said pathways having an energy generating element for generating energy for discharging an ink from said discharging outlet, a discharging outlet face having a discharging outlet surface, said discharging outlets being arranged in said discharging outlet surface, a water-repellent discharging outlet peripheral region circumscribing said discharging outlets, and having a first side and a second side, and a discontinuous hydrophilic region containing a number of portions having a hydrophilic nature relative to said discharging outlet peripheral region and which portions are spacedly distributed in said discontinuous hydrophilic region, said discontinuous hydrophilic region being positioned on at least one said side of said discharging outlet peripheral region, said discontinuous hydrophilic region being separated by a predetermined distance from said discharging outlet peripheral region; and a capping means for capping and thereby protecting the discharging outlets, said capping means also being used in a recovery of the discharging outlets so as to restore their discharging performance.

10. an ink jet head, comprising:

a plurality of discharging outlets disposed in an arrangement direction;

a plurality of ink pathways, each said ink pathway communicating with an associated said discharging outlet, each of said ink pathways having an energy generating element for generating energy for discharging an ink from said discharging outlet; and a discharging outlet face having a discharging outlet surface, said discharging outlets being arranged in said discharging outlet surface, a water-repellent discharging outlet peripheral region circumscribing said discharging outlets, and having a first side and a second side, and a recessed hydrophilic region circumscribing said water-repellent region, said recessed hydrophilic region being positioned along the arrangement direction of the discharging outlets on at least one said side of said discharging outlet peripheral region, said recessed hydrophilic region being separated by a predetermined distance from said discharging outlet peripheral region.

11. An ink jet apparatus, comprising:

an ink jet head which comprises:

a plurality of discharging outlets disposed in an arrangement direction;

a plurality of ink pathways, each said ink pathway communicating with an associated said discharging outlet, each of said ink pathways having an energy generating element for generating energy for discharging an ink from said discharging outlet; and a discharging outlet face having a discharging outlet surface, said discharging outlets being arranged in said discharging outlet surface, a water-repellent discharging outlet peripheral region circumscribing said discharging outlets, and having a first side and a second side, and a recessed hydrophilic region circumscribing said water-repellent region, said recessed hydrophilic region being positioned along the arrangement direction of the discharging outlets on at least one said side of said discharging outlet peripheral region, said recessed hydrophilic region being separated by a predetermined distance from said discharging outlet peripheral region; and a cleaning blade for wiping and thereby cleaning said discharging outlet face as a consequence of a movement relative to said discharging outlet face.

12. An ink jet apparatus, comprising:

an ink jet head which comprises:

a plurality of discharging outlets disposed in an arrangement direction;

a plurality of ink pathways, each said ink pathway communicating with an associated said discharging outlet, each of said ink pathways having an energy generating element for generating energy for discharging an ink from said discharging outlet; and a discharging outlet face having a discharging outlet surface, said discharging outlets being arranged in said discharging outlet surface, a water-repellent discharging outlet peripheral region circumscribing said discharging outlets, and having a first side and a second side, and a recessed hydrophilic region circumscribing said water-repellent region, said recessed hydrophilic region being positioned along the arrangement direction of the discharging outlets on at least one said side of said discharging outlet peripheral region, said recessed hydrophilic region being separated by a predetermined distance from said discharging outlet peripheral region; and a capping means for capping and thereby protecting the discharging outlets, said capping means also being used in a recovery of the discharging outlets so as to restore their discharging performance.

* * * * *

UNITED STATES PATENT AND TRADEMARK OFFICE

CERTIFICATE OF CORRECTION

PATENT NO. : 5,798,778

DATED : August 25, 1998

INVENTOR(S) : MAKIKO KIMURA ET AL.

It is certified that error appears in the above-identified patent and that said Letters Patent is hereby corrected as shown below:

On the title page:

AT [30], Foreign Application Priority Data

FAPD, "4-280725" should read --4-280275--; and
"4-280726" should read --4-280276--.

COLUMN 3

Line 10, "outlets" should read --outlet--;
Line 61, "conducting" should read --conducted--; and
Line 66, "in to" should read --into--.

COLUMN 5

Line 40, "specedly" should read --spacedly--;
Line 47, "such" should read --such a--;
Line 53, "stable" should read --stably--; and
Line 56, "specedly" should read --spacedly--.

COLUMN 6

Line 1, "zones" should read --zone--;
Line 5, "zones" should read --zone--;
Line 6, "drop let" should read --droplet--;
Line 29, "produced" should read --produce--;
Line 43, "or/and" should read --and/or--;
Line 45, "1,5 mm" should read --1.5 mm--;
Line 49, "operation" should read --operations--;
Line 58, "head. And" should read --head and--; and
Line 65, "operation." should read --operations.--.

UNITED STATES PATENT AND TRADEMARK OFFICE

CERTIFICATE OF CORRECTION

PATENT NO. : 5,798,778

DATED : August 25, 1998

INVENTOR(S) : MAKIKO KIMURA ET AL.

It is certified that error appears in the above-identified patent and that said Letters Patent is hereby corrected as shown below:

COLUMN 9

Line 9, "recesses" should read --recess--;
Line 15, "providing" should be deleted;
Line 24,"resultant" should read --result--; and
Line 54, "other" should read --another--.

COLUMN 10

Line 19, "according head" should be deleted; and
Line 42, "length 1," should read --length $\ell$,--.

COLUMN 11

Line 32, "zones" should read --zone--; and
Line 34, "recesses" should read --recess--.

COLUMN 13

Line 21, "at" should read --at an--.

COLUMN 14

Line 16, "recesses" should read --recess--.

COLUMN 15

Line 44, "because" should read --because of--;
Line 46, "provide" should read --provided--; and
Line 67, "of the" should be deleted.

UNITED STATES PATENT AND TRADEMARK OFFICE

CERTIFICATE OF CORRECTION

PATENT NO. : 5,798,778

DATED : August 25, 1998

INVENTOR(S) : MAKIKO KIMURA ET AL.

It is certified that error appears in the above-identified patent and that said Letters Patent is hereby corrected as shown below:

COLUMN 16

Line 15, "of the" should be deleted.

COLUMN 17

Line 1, "materia" should read --material--;
Line 18, "KYNARSL/KYNAR-ADS" should read --KYNAR-SL/KYNAR-ADS--; and
Line 63, "serve" should read --serves--.

COLUMN 18

Line 34, "corresponds" should read --corresponds to--;
Line 37, "The" should read --the--;
Line 39, "termes" should read --terms of--;
Line 53, "are sometimes remained" should read --sometimes remain--; and
Line 57, "become not" should read --do not come--.

COLUMN 19

Line 9, "recesses" should read --recess--;
Line 10, "different as" should read --different--;
Line 17, "recesses." should read --recess.--; and
Line 59, "different as" should read --different--.

COLUMN 20

Line 37, "give" should read --given--; and
Line 39, "different as" should read --different--.

UNITED STATES PATENT AND TRADEMARK OFFICE

CERTIFICATE OF CORRECTION

PATENT NO. : 5,798,778

DATED : August 25, 1998

INVENTOR(S) : MAKIKO KIMURA ET AL.

It is certified that error appears in the above-identified patent and that said Letters Patent is hereby corrected as shown below:

COLUMN 21

Line 31, "head head." should read --head.--;
Line 38, "movie" should read --move--; and
Line 59, "such" should read --such a--.

COLUMN 22

Line 45, "rubb" should read --rub--.

COLUMN 23

Line 22, "be" should be deleted; and
Line 23, "always" should read --always be--.

COLUMN 24

Line 12, "face)" should read --face--;
Line 18, "was" should be deleted;
Line 29, "a" should read --an--; and
Line 37, "a" should read --an--.

COLUMN 25

Line 20, "provide" should be deleted.

UNITED STATES PATENT AND TRADEMARK OFFICE

CERTIFICATE OF CORRECTION

PATENT NO. : 5,798,778

DATED : August 25, 1998

INVENTOR(S) : MAKIKO KIMURA ET AL.

It is certified that error appears in the above-identified patent and that said Letters Patent is hereby corrected as shown below:

In the Claim:

COLUMN 28

Line 53, "an" should read --An--.

Signed and Sealed this

Twenty-seventh Day of April, 1999

*Attest:*

Q. TODD DICKINSON

*Attesting Officer*

*Acting Commissioner of Patents and Trademarks*